US011113916B2

(12) United States Patent
Nishida et al.

(10) Patent No.: US 11,113,916 B2
(45) Date of Patent: Sep. 7, 2021

(54) COIN FEEDING APPARATUS AND MONEY HANDLING APPARATUS

(71) Applicant: GLORY LTD., Himeji (JP)

(72) Inventors: Eisei Nishida, Himeji (JP); Kazuma Sugahara, Himeji (JP); Shuji Onishi, Himeji (JP); Yuji Fujio, Himeji (JP)

(73) Assignee: GLORY LTD., Himeji (JP)

( * ) Notice: Subject to any disclaimer, the term of this patent is extended or adjusted under 35 U.S.C. 154(b) by 0 days.

(21) Appl. No.: 16/891,538

(22) Filed: Jun. 3, 2020

(65) Prior Publication Data

US 2020/0388097 A1 Dec. 10, 2020

(30) Foreign Application Priority Data

Jun. 5, 2019 (JP) ..... JP2019-105245

(51) Int. Cl.
*G07D 3/06* (2006.01)
*G07D 1/00* (2006.01)
(Continued)

(52) U.S. Cl.
CPC ..... *G07D 3/06* (2013.01); *G07D 1/00* (2013.01); *G07D 3/02* (2013.01); *G07D 3/126* (2013.01);
(Continued)

(58) Field of Classification Search
CPC ..... G07D 3/06; G07D 3/126; G07D 9/008; G07D 3/02; G07D 9/06; G07D 3/128;
(Continued)

(56) References Cited

U.S. PATENT DOCUMENTS 3,422,824 A * 1/1969 Persson ..... G07D 9/008 453/8
2010/0042250 A1* 2/2010 Nishida ..... G07D 1/00 700/218
(Continued)

FOREIGN PATENT DOCUMENTS

EP 3267405 A1 1/2008
EP 1998293 A2 12/2008
JP 2012174035 A 9/2012

OTHER PUBLICATIONS

Extended European Search Report dated Nov. 13, 2020 for the corresponding European Patent Application.
(Continued)

*Primary Examiner* — Jeffrey A Shapiro
(74) *Attorney, Agent, or Firm* — Renner, Kenner, Greive, Bobak, Taylor & Weber

(57) ABSTRACT

A coin feeding apparatus comprising: a disk that includes a plurality of protrusions on a surface of the disk, is disposed to be inclined and rotatable, and, when rotating, causes a first coin or a second coin to be caught on and carried upward by the plurality of protrusions, the second coin having a diameter greater than that of the first coin; a cover that forms, between the cover and a surface of the disk, a space for storing a coin therein; and a separation unit that separates one coin out of two of the first coins from the plurality of protrusions so as to cause the one coin to fall into the space, the two first coins being caught on the plurality of protrusions side by side.

10 Claims, 18 Drawing Sheets

(51) Int. Cl.

| | |
|---|---|
| ***G07D 3/16*** | (2006.01) |
| ***G07D 11/00*** | (2019.01) |
| ***G07D 3/12*** | (2006.01) |
| ***G07D 9/00*** | (2006.01) |
| ***G07D 3/02*** | (2006.01) |
| ***G07D 9/06*** | (2006.01) |

(52) U.S. Cl.
CPC ..... *G07D 3/128* (2013.01); *G07D 3/16* (2013.01); *G07D 9/008* (2013.01); *G07D 9/06* (2013.01); *G07D 11/009* (2013.01); *G07D 2201/00* (2013.01)

(58) Field of Classification Search
CPC ..... G07D 1/00; G07D 3/16; G07D 11/009; G07D 2201/00
USPC ..... 453/6, 10, 12, 13, 33, 34, 35, 49, 57
See application file for complete search history.

(56) References Cited

U.S. PATENT DOCUMENTS

| | | | | |
|---|---|---|---|---|
| 2012/0295528 | A1* | 11/2012 | Itou ..... | G07D 9/008 453/57 |
| 2016/0240028 | A1* | 8/2016 | Onishi ..... | G07D 9/008 |
| 2019/0266829 | A1* | 8/2019 | Dano ..... | G07D 9/008 |

OTHER PUBLICATIONS

EP1998293A3 Asahni Seiko., Ltd Dec. 3, 2008—EP Search Report for EP1998293A2.

* cited by examiner

COIN FEEDING APPARATUS AND MONEY HANDLING APPARATUS

CROSS REFERENCE TO RELATED APPLICATIONS

This application is entitled to the benefit of Japanese Patent Application No. 2019-105245, filed on Jun. 5, 2019, the disclosure of which including the specification, drawings and abstract is incorporated herein by reference in its entirety.

TECHNICAL FIELD

The present invention relates to a coin feeding apparatus and a money handling apparatus.

BACKGROUND ART

Conventionally, a money handling apparatus that performs a depositing/dispensing process of money including banknotes and coins has been known. Examples of such a money handling apparatus include an automatic change machine installed in a retail store or a restaurant, a depositing/dispensing machine installed in a financial institution, and the like.

Patent Literature (hereinafter, referred to as "PTL") 1 discloses a coin feeding apparatus that sorts coins put in a machine body through a coin receiving opening by denomination, stores the coins in storing/feeding units corresponding to respective denominations, and feeds coins stored in the storing/feeding units out of the storing/feeding units to dispense the coins to the outside of the machine body.

The coins put in the machine body through the coin receiving opening are temporarily retained, for example, in a retaining/feeding apparatus. The retaining/feeding apparatus is provided with an inclined rotating disk. A plurality of protrusions on which the retained coins are to be caught is disposed on the surface of the disk. The retaining/feeding apparatus causes the retained coins to be caught on and carried upward by a plurality of protrusions disposed on the surface of the disk one by one, so as to feed the coins to a transport path. The coins fed to the transport path are stored in the storing/feeding units corresponding to the respective denominations of the coins.

CITATION LIST

Patent Literature

PTL 1
Japanese Patent Application Laid-Open No. 2012-174035

SUMMARY OF INVENTION

Technical Problem

Incidentally, coins of various diameters exist in the world, ranging from a coin of small diameter to a coin of large diameter. It is conceivable that the retaining/feeding apparatus includes a plurality of protrusions disposed on the surface of the disk such that coins of various diameters can be fed to the transport path.

However, when a plurality of protrusions is disposed on the surface of the disk such that the coins of various diameters can be fed to the transport path, two coins of small diameter may sometimes be caught on the plurality of protrusions side by side, for example. In this case, the two coins are fed to the transport path side by side (in a state of being in contact with or in close proximity to each other). When two coins are transported side by side along the transport path, it is probable that each of the two coins is not properly sorted into the storing/feeding units of the corresponding denominations.

In view of the above, the present invention aims to provide a technique for feeding stored coins ranging from a coin of small diameter to a coin of large diameter one by one to a transport path.

Solution to Problem

A coin feeding apparatus of the present invention comprises: a disk that includes a plurality of protrusions on a surface of the disk, is disposed to be inclined and rotatable, and, when rotating, causes a first coin or a second coin to be caught on and carried upward by the plurality of protrusions, the second coin having a diameter greater than that of the first coin; a cover that forms, between the cover and the surface of the disk, a space for storing a coin therein; and a separation unit that separates one coin out of two of the first coins from the plurality of protrusions so as to cause the one coin to fall into the space, the two first coins being caught on the plurality of protrusions side by side.

A money handling apparatus of the present invention comprises the coin feeding apparatus described above.

Advantageous Effects of Invention

According to the present invention, the stored coins ranging from a coin of small diameter to a coin of large diameter can be fed to the transport path one by one.

DESCRIPTION OF EMBODIMENT

Hereinafter, embodiments of the present invention will be described with reference to the accompanying drawings.

Embodiment 1

Figure 1:
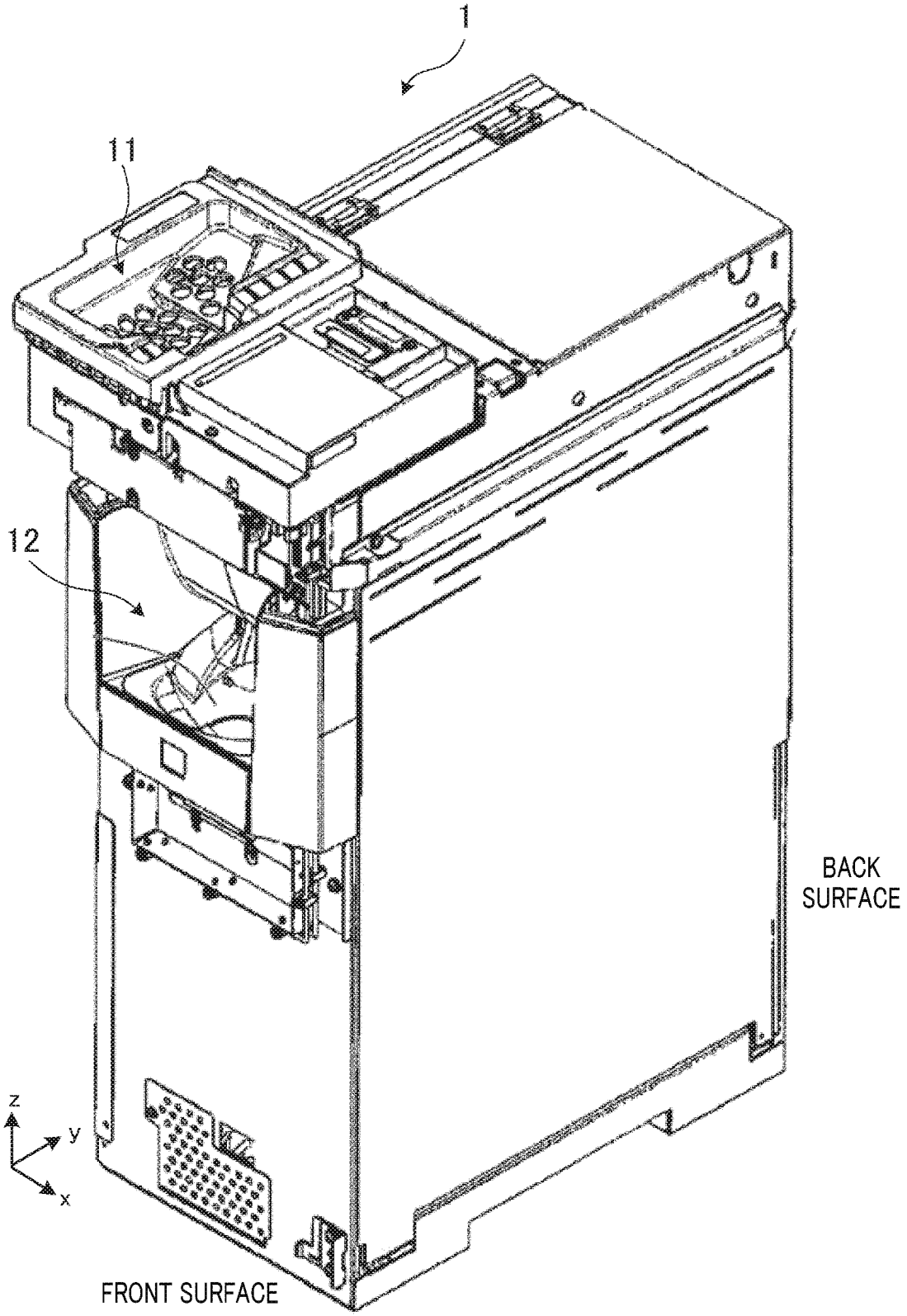
FIG. 1 is an external perspective view of a money handling apparatus according to Embodiment 1.

FIG. 1 is an external perspective view of a money handling apparatus 1 according to Embodiment 1. Hereinafter, coordinates of three axes as illustrated in FIG. 1 are set for the money handling apparatus 1. The negative side of the money handling apparatus 1 in the y-axis direction corresponds to the front surface side of the apparatus. An inlet 11 and an outlet 12, which will be described later, are disposed on the front surface side of the money handling apparatus 1, for example. The positive side of the money handling apparatus 1 in the y-axis direction corresponds to the back surface side of the apparatus.

To begin with, a depositing process, a dispensing process, and a collecting process in the money handling apparatus 1 will be briefly described. The depositing process is a process of counting the deposited coins and accepting the deposit amount. The dispensing process is a process of dispensing coins based on given dispensing information. The dispensing information is specified from, for example, an operation display unit (not illustrated) or a host device (external device). The operation display unit may be disposed, for example, on the upper surface of the housing of the money handling apparatus 1 and behind the inlet 11.

The dispensing information may be the amount of money to be dispensed, or may be the denomination and the number of coins to be dispensed. When the money handling apparatus 1 is an automatic change machine, the dispensing process includes a process of dispensing a change coin. When the money handling apparatus 1 is a money exchange machine, the dispensing process includes a process of dispensing a money exchange coin.

The collecting process is a process of collecting, out of the apparatus, coins existing inside the apparatus. In the collecting process, all the coins existing inside the apparatus may be collected, or only some of the coins may be collected. For the collecting process, there are a method of collecting coins stored in a collecting box (see a collecting box 27 in FIG. 2) and a method of collecting coins from outlet 12, for example.

As illustrated in FIG. 1, the money handling apparatus 1 comprises the inlet 11 and the outlet 12. The inlet 11 is disposed in the upper surface of the housing of the money handling apparatus 1. In the depositing process, a coin put in by a user is received in the apparatus from the inlet 11.

Coins of various denominations are put in the inlet 11, for example. In other words, coins of various diameters are put in the inlet 11. Coins received in the apparatus are sent to a coin feeding apparatus (see a coin feeding apparatus 21 in FIG. 2) by its own weight. The coin feeding apparatus may also be referred to as a retaining/feeding apparatus.

The outlet 12 is disposed in the front surface of the apparatus and below the inlet 11. The coins stored in the money handling apparatus 1 are dispensed to the outlet 12. A rejected coin at the time of deposit is also dispensed to the outlet 12.

Note that, the money handling apparatus 1 may be a money handling apparatus which performs a depositing/dispensing process of banknotes and coins.

Figure 2:
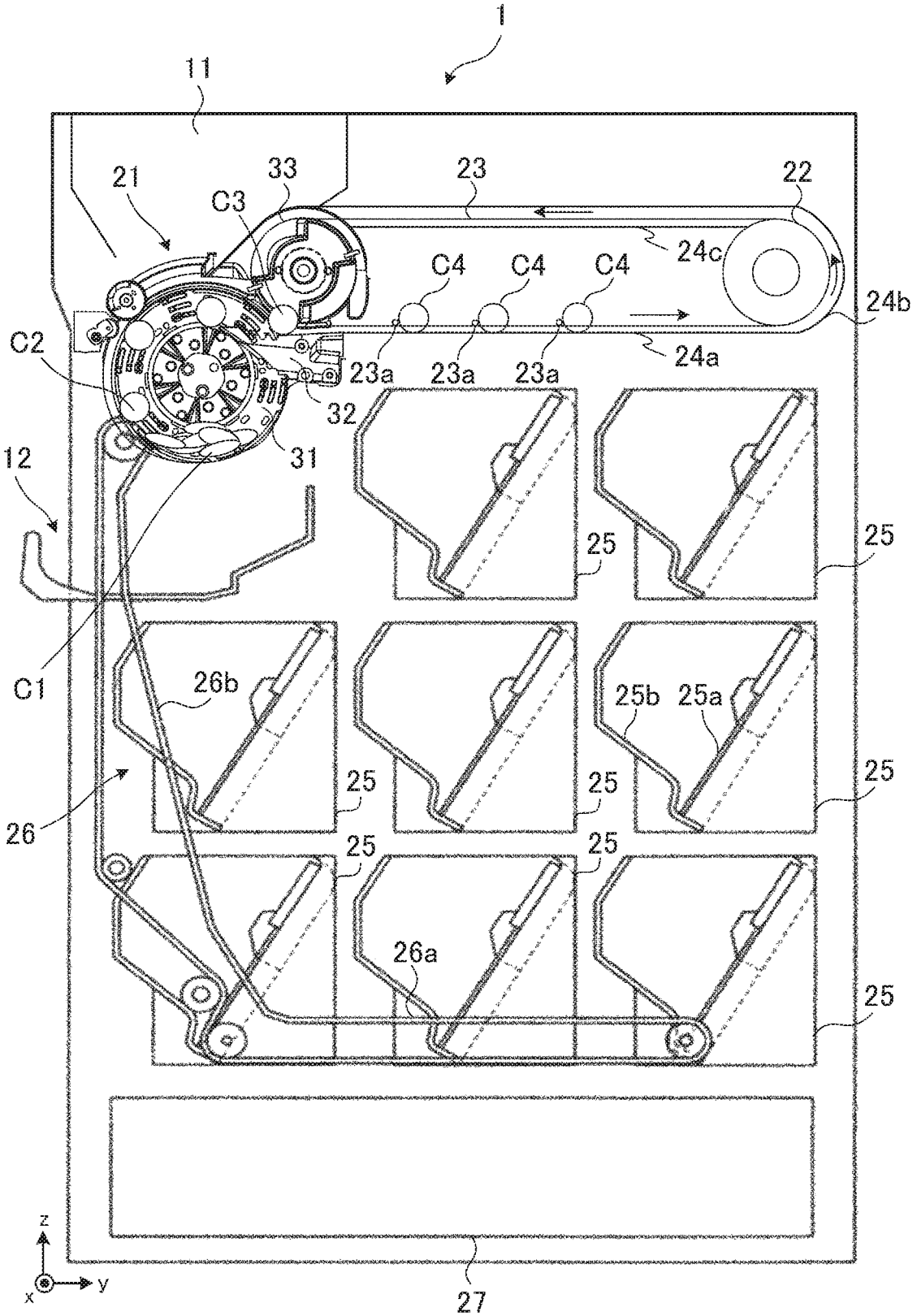
FIG. 2 is a side view illustrating an internal configuration of the money handling apparatus.

FIG. 2 is a side view illustrating an internal configuration of the money handling apparatus 1. The same components between FIGS. 1 and 2 are provided with the same reference symbols. The money handling apparatus 1 illustrated in FIG. 2 is partially modified in shape or the like in comparison with the money handling apparatus 1 illustrated in FIG. 1. As illustrated in FIG. 2, the money handling apparatus 1 comprises a coin feeding apparatus 21, a pulley 22, a belt 23, transport paths 24*a* to 24*c*, storing/feeding units 25, a transport path 26, and a collecting box 27. FIG. 2 also illustrates coins C1 to C4.

The coin feeding apparatus 21 is disposed below the inlet 11, and temporarily stores (retains) coins put in the inlet 11. The coins C1 illustrated in FIG. 2 are coins put in the inlet 11 and temporarily stored in the coin feeding apparatus 21. The coin feeding apparatus 21 feeds the temporarily stored coins C1 one by one to the transport path 24*a*.

As illustrated in FIG. 2, the coin feeding apparatus 21 comprises a disk 31, a guide 32, and a separation disk 33. A plurality of protrusions on which coins are to be caught is disposed on the surface of the disk 31. The disk 31 rotates clockwise in FIG. 2. When the disk 31 rotates clockwise, the coins C1 are caught on and carried upward by a plurality of protrusions disposed on the surface of the disk 31. The coin C2 illustrated in FIG. 2 is a coin caught on and carried upward by a plurality of protrusions of the disk 31.

Figure 3:
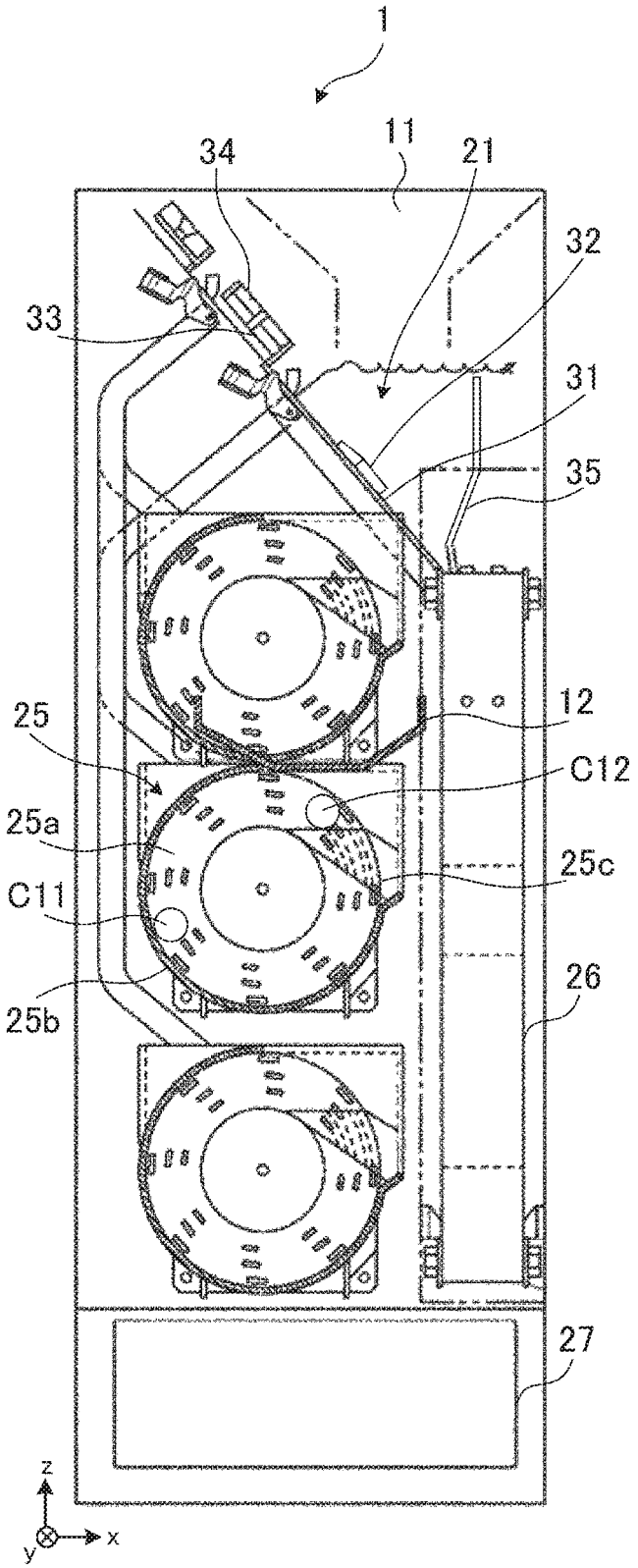
FIG. 3 is a front view illustrating the internal configuration of the money handling apparatus.

FIG. 3 is a front view illustrating the internal configuration of the money handling apparatus 1. The same components between FIG. 3 and FIGS. 1 and 2 are provided with the same reference symbols. The money handling apparatus 1 illustrated in FIG. 3 is partially modified in shape or the like in comparison with the money handling apparatus 1 illustrated in FIG. 1.

As illustrated in FIG. 3, the disk 31 of the coin feeding apparatus 21 is inclined at a predetermined angle with respect to the vertical direction. Thus, the plane of the coin C2 illustrated in FIG. 2 leans on (makes contact with) the surface of the disk 31. Further, the coin C2 illustrated in FIG. 2 is, at its circumferential surface, caught on a plurality of protrusions disposed on the surface of the disk 31 (not illustrated in FIG. 3), and is carried upward with the rotation of the disk 31.

FIG. 3 illustrates a pulley 34 that the coin feeding apparatus 21 comprises (illustration of the pulley 34 is omitted in FIG. 2). The pulley 34 is disposed to overlap the upper surface of the disk-shaped separation disk 33 (see the separation disk 33 and the pulley 34 in FIG. 14).

FIG. 3 illustrates a cover 35 that the coin feeding apparatus 21 comprises. The cover 35 is disposed in the coin feeding apparatus 21 so as to cover the surface of the disk 31.

Figure 4:
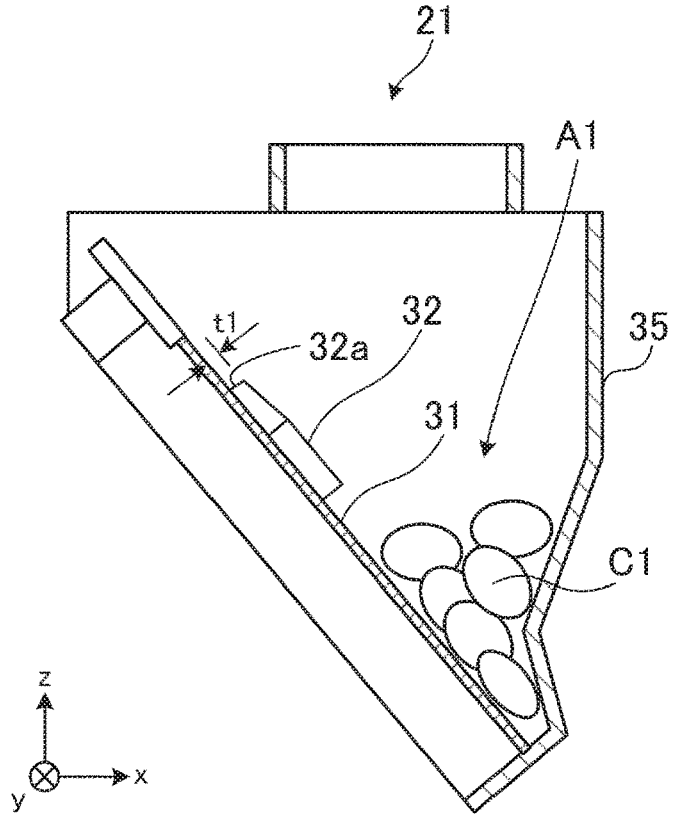
FIG. 4 is a front view illustrating an internal configuration of a coin feeding apparatus.

FIG. 4 is a front view illustrating the internal configuration of the coin feeding apparatus 21. The same components between FIG. 4 and FIGS. 2 and 3 are provided with the same reference symbols. The coin feeding apparatus 21 illustrated in FIG. 4 is partially modified in shape or the like in comparison with the coin feeding apparatus 21 illustrated in FIG. 2 or 3.

As described with reference to FIG. 3, the cover 35 is disposed in the coin feeding apparatus 21 so as to cover the surface of the disk 31. The cover 35 forms, between the cover 35 and the surface of the disk 31, a space A1 for storing coins therein. Coins put in the inlet 11 fall into the space A1 by their own weights. The coins C1 in FIG. 4 represent coins stored in the space A1.

Figure 6:
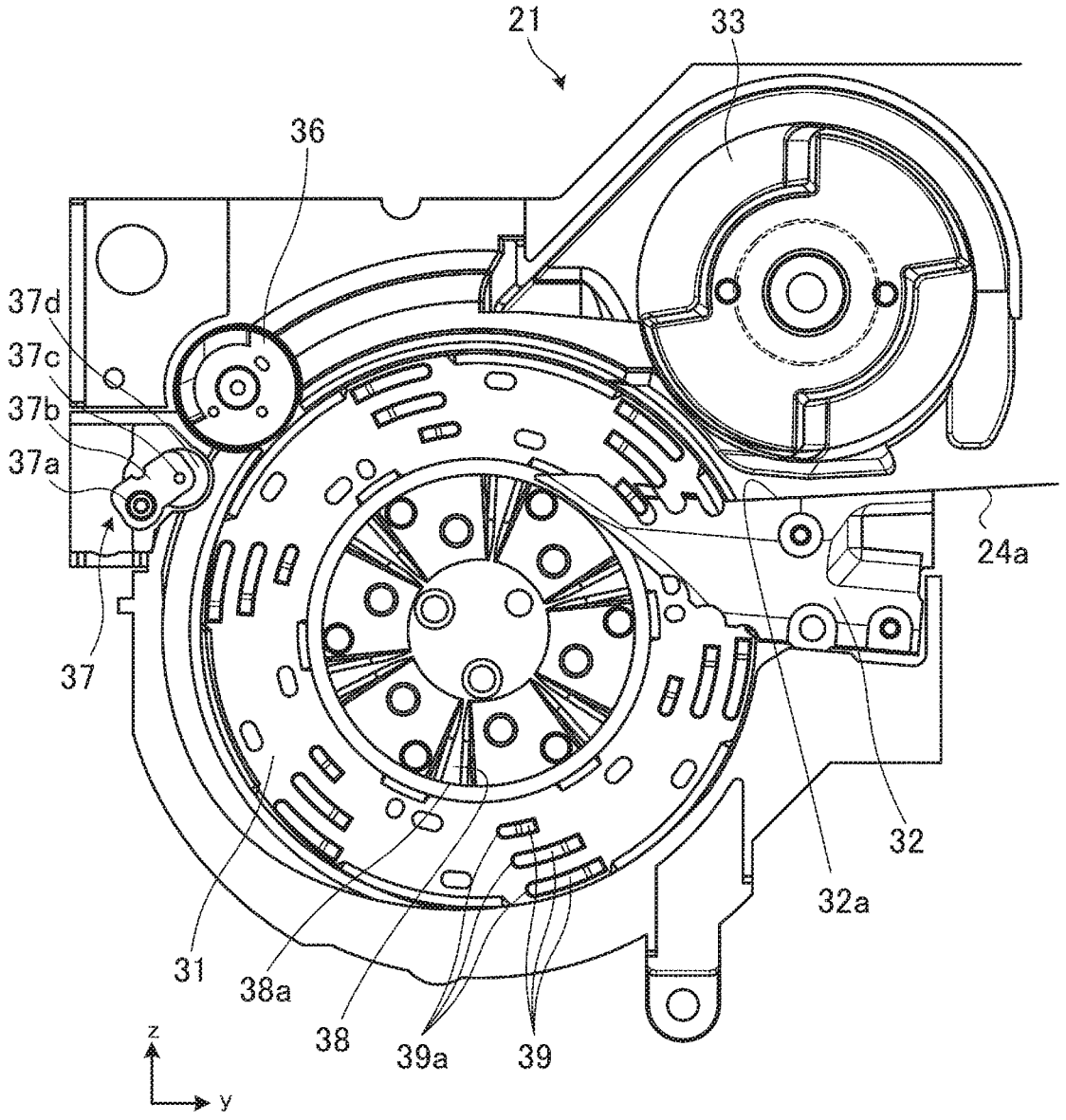
FIG. 6 illustrates the coin feeding apparatus as seen from the surface side of the disk.

The guide 32 is a plate-like member, and is disposed such that its flat surface faces the surface of the disk 31 (see the guide 32 in FIG. 6). The upper surface 32*a* of the guide 32 extends along a substantially horizontal direction (see the upper surface 32*a* of the guide 32 in FIG. 6). The thickness t1 of the upper surface 32*a* of the guide 32 is great enough for the circumferential surface of each of the coins C1 temporarily stored in the space A1 (see the coin C3 placed on the guide 32 in FIG. 2) to be placed on the upper surface 32*a* of the guide 32. There are three grooves formed in the surface of the guide 32 facing the surface of the disk 31, through which a plurality of protrusions disposed on the surface of the disk 31 (not illustrated in FIG. 4) passes. The guide 32 separates from the disk 31 a coin carried upward by the disk 31, and guides the coin to the transport path 24*a*.

A description will be given with reference to FIG. 2 again. The coins C1 are caught on a plurality of protrusions disposed on the surface of the rotating disk 31, and carried upward as indicated by the coin C2. The coins carried upward by the coin feeding apparatus 21 are placed on the upper surface 32*a* of the guide 32 as indicated by the coin C3 so as to be separated from the disk 31 and fed to the transport path 24*a*.

The transport path 24*a* is disposed above the coin feeding apparatus 21, and transports the coins fed by the coin feeding apparatus 21 one by one. The transport path 24*a* extends along the substantially horizontal direction, and transports the coins fed from the coin feeding apparatus 21 toward the back surface of the money handling apparatus 1 (in the positive y-axis direction). The transport path 24*b* has a curved shape (here, semicircular-arc shape), and changes the transport direction of the coins sent by the transport path 24*a* to the reverse direction. The transport path 24*c* extends along the substantially horizontal direction, and transports the coins sent by the transport path 24*b* toward the front surface of the money handling apparatus 1 (in the negative y-axis direction).

The belt 23 is an endless belt wound around the pulley 22 and the pulley 34 under tension. The belt 23 circulates in one direction (counterclockwise in FIG. 2) by driving a motor (not illustrated) mounted on either one of the pulley 22 and the pulley 34.

The belt 23 includes pins 23*a*. FIG. 2 illustrates only three pins 23*a*, but four or more pins are disposed at equal intervals over the entire circumference of the belt 23. Each of the pins 23*a* pushes the rear side of the circumferential surface of a coin fed from the coin feeding apparatus 21 to the transport path 24*a*. The coins C4 represent coins that are, at the rear sides of their circumferential surfaces, pushed by the pins 23*a*. The rear sides of the circumferential surfaces of the coins C4 are pushed by the pin 23*a*, so that the coins C4 on the transport path 24*a* are transported toward the back surface of the money handling apparatus 1.

Figure 5:
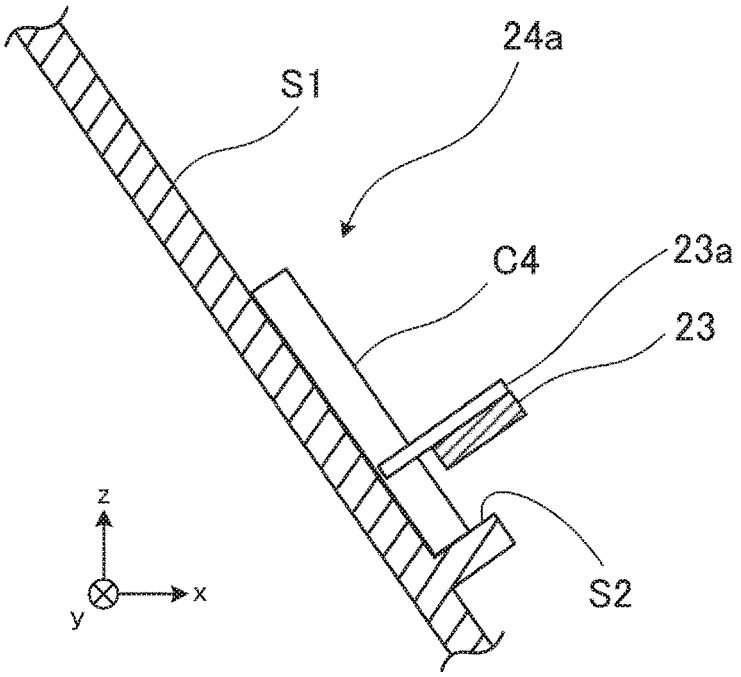
FIG. 5 is a sectional view of a transport path in the money handling apparatus as seen in front view.

FIG. 5 is a sectional view of the transport path 24*a* in the money handling apparatus 1 as seen in front view. The same components between FIGS. 5 and 2 are provided with the same reference symbols.

As illustrated in FIG. 5, the transport path 24*a* is formed by an inclined side surface S1 and a bottom surface S2. The side surface S1 and the bottom surface S2 form approximately 90 degrees. The bottom surface S2 is, on the negative side in the y-axis direction, connected to the upper surface 32*a* of the guide 32. The planes of the coins C4 transported on the transport path 24*a* are supported by the side surface S1 of the transport path 24*a*, and the lower ends of the circumferential surfaces of the coins C4 are supported by the bottom surface S2. That is, the coins C4 are transported on the transport path 24*a* while maintained at a predetermined inclination angle (inclination angle of the side surface S1).

The coins C4 supported by the side surface S1 and the bottom surface S2 are transported toward the transport path 24*b* while the rear sides of the circumferential surfaces of the coins C4 are pushed by the pins 23*a* disposed on the belt 23. The direction of the coins C4 is converted by the transport path 24*b*, and the coins C4 are transported to the transport path 24*c*. The transport paths 24*b* and 24*c*, like the transport path 24*a*, also have the side surface and the bottom surface.

A description will be given with reference to FIG. 2 again. The coin feeding apparatus 21 comprises a plurality of sorting units (not illustrated) for sorting coins transported on the transport paths 24*a* and 24*c*. The sorting units are disposed along the transport paths 24*a* and 24*c*. For example, three sorting units are disposed along the transport path 24*a*, and five sorting units are disposed along the transport path 24*c*.

A plurality of sorting units (e.g., eight sorting units) is connected respectively to a plurality of storing/feeding units 25 (eight storing/feeding units in the example of FIG. 2) via chutes (not illustrated). The sorting units sort the coins transported on the transport paths 24*a* and 24*c* by denomination based on a recognition result of a recognition unit (not illustrated), and sends the coins toward the storing/feeding units 25 via the chutes.

A plurality of the storing/feeding unit 25 is disposed below the transport path 24*a*. For example, the storing/feeding units 25 are vertically disposed in three stages (two storing/feeding units 25 in the upper stage, three storing/feeding units 25 in the middle stage, and three storing/feeding units 25 in the lower stage). All the storing/feeding units 25 may have the same configuration. The storing/feeding units 25 store therein coins transported by the transport paths 24*a* and 24*c* and sent the coins via the chutes. The storing/feeding units 25 also feed the stored coins one by one to the transport path 26.

As described above, the coins sorted by denomination by the sorting units are stored in the storing/feeding units 25. Correspondingly, the storing/feeding units 25 are associated respectively with the denominations of the coins, and each of the storing/feeding units 25 stores coins of a specific denomination.

Each of the storing/feeding units 25 includes a disk 25*a* that rotates, and a cover 25*b*. The disk 25*a*, like the disk 31 of the coin feeding apparatus 21, is disposed to be inclined at a predetermined angle with respect to the vertical direction, rotates in an inclined posture. The cover 25*b* is formed to cover the surface of the disk 25*a*. The cover 25*b* forms, between the cover 25*b* and the surface of the disk 25*a*, a space for storing therein coins sorted by the sorting units.

Here, a description will be given of the storing/feeding units 25 with reference to FIG. 3. As illustrated in FIG. 3, the disk 25*a* includes a plurality of protrusions on its surface. The disk 25*a* rotates clockwise in FIG. 3. When the disk 25*a* rotates clockwise, coins sorted by the sorting units and stored in the storing/feeding unit 25 are caught on and carried upward by a plurality of protrusions. A coin C11 illustrated in FIG. 3 is a coin caught on and carried upward by a plurality of protrusions of the disk 25*a*.

As illustrated in FIG. 3, each of the storing/feeding units 25 has a guide 25*c*. The guide 25*c* is a plate-like member, and is disposed to face the surface of the disk 25*a*. For example, a coin carried upward by the disk 25*a* is placed on the upper surface of the guide 25*c* as indicated by a coin C12 in FIG. 3, so as to be separated from the disk 25*a* and dispensed to the transport path 26. Note that, three grooves through which a plurality of protrusions disposed on the surface of the disk 25*a* passes are formed in the surface of the guide 25*c* making contact with the surface of the disk 25*a*.

A feeding direction of coins fed from the storing/feeding units 25 is substantially orthogonal to the transport direction of the coins transported by the transport paths 24*a* to 24*c*. For example, the transport direction of the coins transported by the transport path 24*a* is the positive y-axis direction and the transport direction of the coins transported by the transport path 24*c* is the negative y-axis direction. Unlike this, the feeding direction of the coin C12 fed from the storing/feeding unit 25 is the positive x-axis direction.

A description will be given with reference to FIG. 2 again. In the dispensing process or the collecting process, the transport path 26 (transport belt) transports to the outlet 12 the coins fed from each of the storing/feeding units 25. The transport path 26 includes a transport unit 26*a* and a transport unit 26*b*. The transport unit 26*a* extends in the substantially horizontal direction below the storing/feeding units 25. The coins fed from the storing/feeding units 25 fall onto the transport unit 26*a* (for example, the coin C12 illustrated in FIG. 3 travels along the upper surface of the guide 25*c* and falls onto the transport unit 26*a*). The transport unit 26*b* carries upward the coins transported from the transport unit 26*a*, and transports the coins to the outlet port 12.

The collecting box 27 is a spare storing unit disposed below the transport path 26. The collecting box 27 is detachably disposed in the money handling apparatus 1. The collecting box 27 is used, for example, in the collecting process. The collecting box 27 is also used in an overflow process in which coins overflowed from any of the storing/feeding units 25 are transported to the collecting box 27 by the transport path 26, for example. The coins which are to be collected can be collected together with the collecting box 27 by a user by taking out the collecting box 27 from the money handling apparatus 1.

Incidentally, the coin feeding apparatus 21 carries upward the stored coins one by one and feeds them to the transport path 24*a*. For example, the coin feeding apparatus 21 carries upward the stored coins one by one as indicated by the coin C2 in FIG. 2. Accordingly, a single one of the pins 23*a* transports a single coin C4 as illustrated in FIG. 2. Consequently, the coins transported on the transport paths 24*a* to 24*c* are appropriately sorted by the sorting units.

Further, a case will be considered in which the coin feeding apparatus 21 carries upward two of the stored coins lying side-by-side (see two side-by-side coins C21 and C22 illustrated in FIG. 9) and feeds them to the transport path 24*a*. In this case, the two coins carried upward side by side are fed to the guide 32 side by side (see FIG. 17A), and a single pin 23*a* transports the two side-by-side coins. There is a possibility that the two side-by-side coins transported on the transport paths 24*a* to 24*c* are not properly sorted by the sorting units. For example, the two side-by-side coins are of different denominations and are to be sorted by different sorting units. When two coins are transported side by side, the sorting units may sometimes be incapable of sending a single coin alone to the chutes, and may send the two coins to the chutes at the same time. Thus, two coins of different denominations may sometimes be unable to be sorted and may be stored in one storing/feeding unit 25.

As is understood, when the disk 31 carries upward two side-by-side coins, the sorting units sometimes fail to sort the coins properly. In order to carry upward coins one by one, several arrangement patterns of the plurality of protrusions of the disk 31 are prepared to fit the diameters of coins handled by the money handling apparatus 1. For example, three arrangement patterns of the plurality of protrusions of the disk 31 are prepared. Three arrangement patterns of the plurality of protrusions of the disk 31 are prepared, for example, to fit the following diameters of coins.

Pattern 1: Diameters of from 16.0 mm to 26.5 mm

Pattern 2: Diameters of from 17.9 mm to 28.5 mm

Pattern 3: Diameters of from 19.41 mm to 31.65 mm

The disk 31 of Pattern 1 can carry upward coins one by one as long as the coins have diameters of from 16.0 mm to 26.5 mm. The disk 31 of Pattern 2 can carry upward coins one by one as long as the coins have diameters of from 17.9 mm to 28.5 mm. The disk 31 of Pattern 3 can carry upward coins one by one as long as the coins have diameters of from 19.41 mm to 31.65 mm.

Countries around the world have coins of various diameters. Accordingly, it is conceivable to replace the disk 31 depending on the country where the money handling apparatus 1 is used. For example, suppose that the diameters of coins circulating in country A are in the range of from 16.0 mm to 26.5 mm in diameter. In this case, the disk 31 of Pattern 1 is used for the disk 31 of the coin feeding apparatus 21. Further, suppose that the diameters of coins circulating in country B are in the range of from 19.41 mm to 31.65 mm in diameter. In this case, the disk 31 of Pattern 3 is used for the disk 31 of the coin feeding apparatus 21.

Preparing a plurality of types of disks 31 (preparing three patterns 1, 2, and 3 in the above example) as described above is costly. Replacing the disk 31 depending on the country is also costly.

To achieve cost reduction, it is conceivable to dispose a plurality of protrusions on the surface of the disk 31 such that a wide range of diameters of coins are carried upward by a single type of disk. However, when such a plurality of protrusions are disposed, a plurality of coins may sometimes be caught on the plurality of protrusions (for example, see the coins C21 and C22 in FIG. 9). For example, when a plurality of protrusions are disposed on the surface of the disk 31 such that coins having diameters of form 14.0 mm to 33.0 mm are carried upward, a plurality of coins may be caught on the plurality of protrusions.

To avoid this, the coin feeding apparatus 21 carries upward a wide range of diameters of coins, and feeds the upwardly-carried coins to the transport path 24*a* one by one.

FIG. 6 illustrates the coin feeding apparatus 21 seen from the surface side of the disk 31. The same components between FIG. 6 and FIGS. 2 to 4 are provided with the same reference symbols. As illustrated in FIG. 6, the coin feeding apparatus 21 comprises a separation cam 36, a pushing-aside lever 37, first protrusions 38, and second protrusions 39.

The separation cam 36 is disposed in the periphery (vicinity) of the disk 31 and on the upper-half side of the disk 31. The separation cam 36 is also disposed in the periphery of the disk 31 and on the side where the peripheral edge of the rotating disk 31 ascends. For example, the disk 31 rotates clockwise in FIG. 6. The peripheral edge of the right half of the disk 31 descends and the peripheral edge of the left half ascends. Thus, in FIG. 6, the separation cam 36 is disposed in the periphery of the disk 31 and on the left-half side of the disk 31. In other words, the separation cam 36 is disposed in the periphery of the disk 31 on the side where coins are carried upward (for example, the side where the coin C2 in FIG. 2 is carried upward, that is, the left-half side of the disk 31) and in the periphery of the disk 31 on the upper-half side.

The separation cam 36 seen from the surface side of the disk 31 has a circular shape. The separation cam 36 is disposed such that the peripheral edge of the separation cam 36 is close to the peripheral edge of the disk 31. The separation cam 36, like the disk 31, is inclined at a predetermined angle with respect to the vertical direction.

The separation cam 36 is rotated, for example, by a motor (not illustrated) being driven. The rotational direction of the separation cam 36 is opposite to the rotational direction of the disk 31. In FIG. 6, the disk 31 rotates clockwise and, accordingly, the separation cam 36 rotates counterclockwise.

The pushing-aside lever 37 is disposed in the periphery of the disk 31 and below the separation cam 36. The pushing-aside lever 37 includes a shaft 37*a*, support members 37*b*, a shaft 37*c*, and a bearing 37*d*.

The support members 37*b* are plate-like members. The support members 37*b* are rotatably fixed by the shaft 37*a* to the housing of the coin feeding apparatus 21. The bearing 37*d* is sandwiched between two plate-like support members 37*b*. The bearing 37*d* is rotatably fixed by the shaft 37*c* to the support members 37*b*.

The first protrusions 38 are disposed on the surface of the disk 31. The first protrusions 38 are disposed on the central portion of the disk 31 and each have a surface 38*a* facing in the radial direction of the disk 31. In the example of FIG. 6, six first protrusions 38 are disposed on the surface of the disk 31 radially at every certain angle (at every 60 degrees).

The second protrusions 39 are disposed on the surface of the disk 31. The second protrusions 39 are disposed outside the first protrusions 38 and each have a surface 39*a* facing in the circumferential direction of the disk 31. In the example of FIG. 6, six second protrusions 39 are disposed on the surface of the disk 31 radially at every certain angle (at every 60 degrees).

The first protrusions 38 are disposed between two neighboring second protrusions 39. In other words, there is not any second protrusion 39 disposed in the radial direction of the disk 31 from the surfaces 38*a* of the first protrusions 38.

The coins stored in the coin feeding apparatus 21 are located between two neighboring second protrusions 39, and are supported and carried upward by the surfaces 39*a* of the second protrusions (see the coin C2 in FIG. 2). The coins carried upward by the second protrusions 39 tend to fall vertically downward due to their own weights. The coins tending to fall vertically downward are supported by the surfaces 38*a* of the first protrusions 38 (see a coin on the left of the coin C3 in FIG. 2). Accordingly, the coins carried upward by the disk 31 are conveyed to the guide 32 without falling.

The first protrusions 38 and the second protrusions 39 are disposed on the surface of the disk 31 so as to carry upward a wide range of diameters of coins. For example, the first protrusions 38 and the second protrusions 39 are disposed on the surface of the disk 31 so as to carry upward coins having diameters of from 14.0 mm to 33.0 mm. When the first protrusions 38 and the second protrusions 39 are disposed on the surface of the disk 31 so as to carry upward a wide range of diameters of coins, two coins having a small diameter may be inserted between two neighboring second protrusions 39. The separation cam 36 separates one of the two coins from the disk 31 and causes the coin to fall into the space A1 such that a single coin is carried upward.

Figure 7:
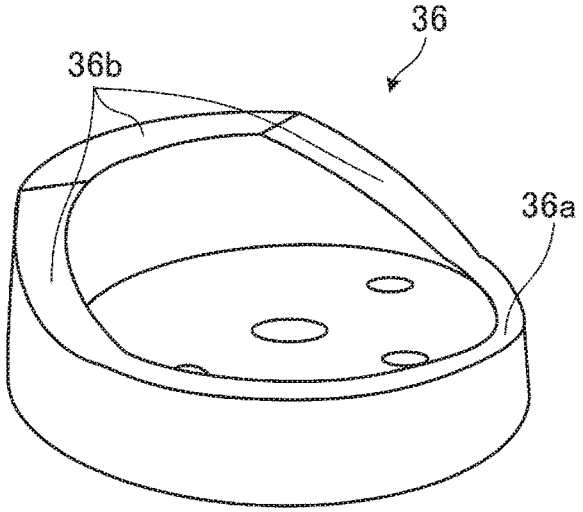
FIG. 7 is a perspective view of a separation cam.

FIG. 7 is a perspective view of the separation cam 36. The separation cam 36 illustrated in FIG. 7 is partially modified in shape or the like in comparison with the separation cam 36 illustrated in FIG. 6. The separation cam 36 is substantially cylindrical and has a cylindrical end surface provided with a lower portion and a higher portion. For example, the separation cam 36 includes a flat lower portion 36*a* and a flat higher portion 36*b* higher than the lower portion 36*a* as illustrated in FIG. 7.

Figure 8:
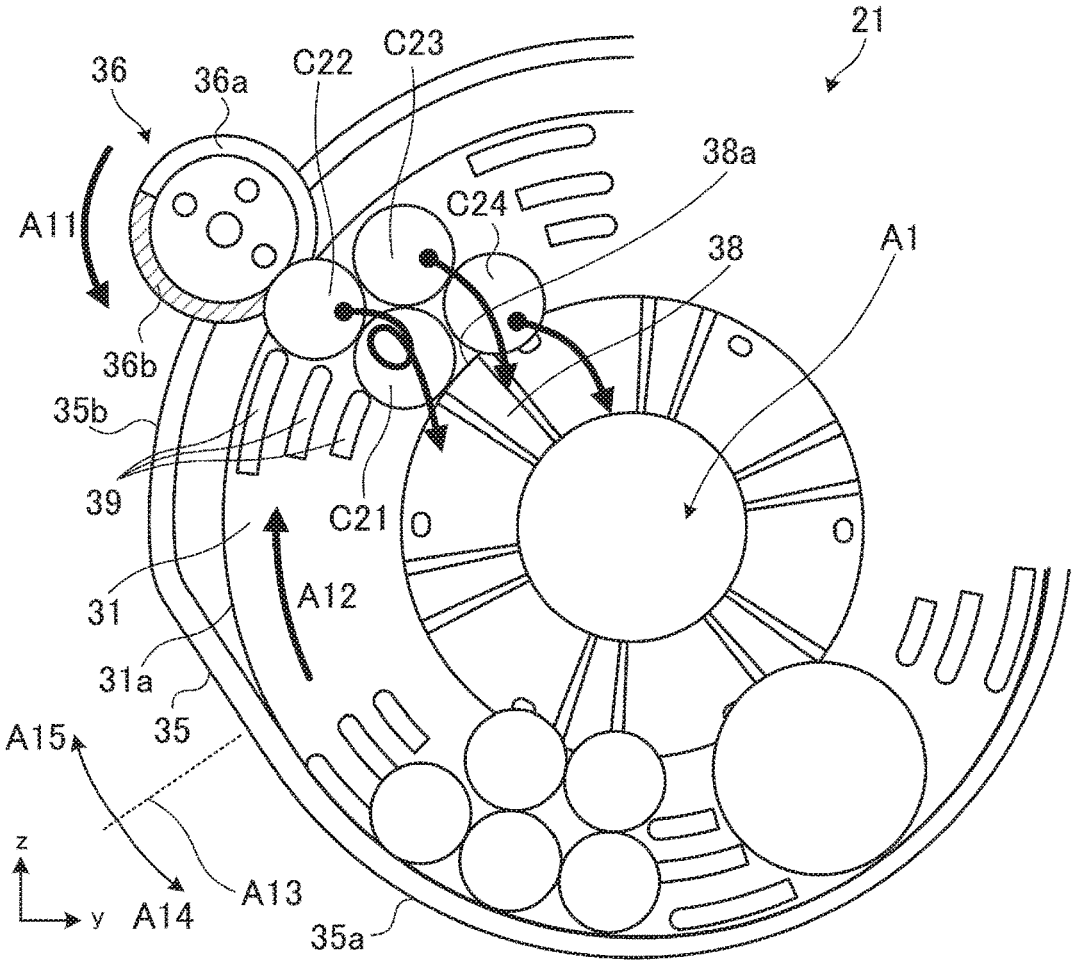
FIG. 8 illustrates a part of the coin feeding apparatus.

FIG. 8 illustrates a part of the coin feeding apparatus 21. The same components between FIG. 8 and FIGS. 6 and 7 are provided with the same reference symbols. The coin feeding apparatus 21 illustrated in FIG. 8 is partially modified in shape or the like in comparison with the coin feeding apparatus 21 illustrated in FIGS. 6 and 7. Note that, in FIG. 8, the higher portion 36*b* is indicated by hatching such that the lower portion 36*a* is easily distinguished from the higher portion 36*b* of the separation cam 36. FIG. 8 also illustrates a part of a section of the cover 35 illustrated in FIGS. 3 and 4. Further, an arrow A11 in FIG. 8 indicates the rotational direction of the separation cam 36. An arrow A12 in FIG. 8 indicates the rotational direction of the disk 31.

The surface of the lower portion 36*a* of the separation cam 36 is flush with or lower than the surface of the disk 31. The surface of the higher portion 36*b* of the separation cam 36 is higher than the surface of the disk 31.

Rotation of the disk 31 and rotation and the separation cam 36 are synchronized. The separation cam 36 rotates once each time the disk 31 rotates 60 degrees. For example, as described above, six first protrusions 38 and six second protrusions 39 are disposed on the surface of the disk 31 at equal angles. Accordingly, the separation cam 36 rotates once each time one of the first protrusions 38 and one of the second protrusions 39 pass in front of the separation cam 36. In other words, the separation cam 36 rotates once each time an upwardly-carried coin passes in front of the separation cam 36.

The coins C21 to C24 in FIG. 8 represent coins that are caught on and carried upward by the second protrusions 39 of the disk 31. The coins C21 and C22 are caught on the second protrusions 39 of the disk 31 while lying side-by-side in the radial direction of the disk 31. The coins C23 and C24 are placed on the coins C21 and C22.

The coin C21 is supported by one of the second protrusions 39 and the surface 38*a* of one of the first protrusions 38, and continues to be carried upward. The coin C24 is not supported by the surfaces 38*a* of the first protrusions 38 and, thus, falls into the space A1 by its own weight. Like the coin C24, the coin C23 also falls into the space A1 by its own weight. That is, when carried upward, the coins C23 and C24 fall into the space A1 by their own weights.

The coin C22 tends to fall into the space A1 due to its own weight, but is blocked by the coin C21. However, the coin C22 partially comes into contact with the higher portion 36*b* of the rotating separation cam 36, so as to be scooped up (lifted) from the surface of the disk 31 and fall into the space A1.

That is, of the coins C21 to C24, the coins C23 and C24 placed on the coins C21 and C22 fall into the space A1 due to their own weights when the coins C23 and C24 are carried upward with the rotation of the disk 31. In addition, of the two coins C21 and C22 remaining on the disk 31, the outer coin C22 is scooped up from the surface of the disk 31 by the separation cam 36 and falls into the space A1. One coin C21 is thus carried upward and fed to the guide 32. Note that, the coins C23 and C24 fall into the space A1 due to their own weights before the coin C22 is scooped up by the separation cam 36.

The cover 35 includes a side wall 35*a* disposed along the peripheral edge 31*a* of the disk 31, and a side wall 35*b* disposed to diverge from the peripheral edge 31*a* of the disk 31 with decreasing distance to the separation cam 36. For example, a portion of the cover 35 on one side indicated by an arrow A14 with respect to a boundary indicated by a dotted line A13 in FIG. 8 is shaped to extend along the peripheral edge 31*a* of the disk 31. Further, a portion of the cover 35 on another side indicated by an arrow A15 with respect to the boundary indicated by the dotted line A13 in FIG. 8 is shaped to diverge from the peripheral edge 31*a* of the disk 31.

The first protrusions 38 and the second protrusions 39 are disposed on the disk 31 such that when two coins are caught on the first protrusions 38 and the second protrusions 39 while lying side-by-side in the radial direction of the disk 31, a portion of outer one of the coins projects out from the peripheral edge 31*a* of the disk 31. For example, a portion of the coin C22, which is an outer coin of the two coins C21 and C22 caught on while lying side-by-side in the radial direction of the disk 31, projects out from the peripheral edge 31*a* of the disk 31. The first protrusions 38 and the second protrusions 39 are disposed on the disk 31 such that when a single coin having a diameter equal to or greater than a predetermined value (a coin C25 indicated by a dotted line in FIG. 9) is caught on the first protrusions 38 and the second protrusions 39, a portion of the coin projects out from the peripheral edge 31*a* of the disk 31. The side wall 35*b* of the cover 35 is shaped to diverge from the peripheral edge 31*a* of the disk 31 to allow a portion of the outer coin C22 to project out from the peripheral edge 31*a* of the disk 31, and a portion of the coin having a diameter equal to or greater than a predetermined value to project out from the peripheral edge 31*a* of the disk 31.

Note that, the first protrusions 38 and the second protrusions 39 may also be disposed on the disk 31 such that two coins having the smallest diameter are caught on the first protrusions 38 and the second protrusions 39 while lying side-by-side in the radial direction of the disk 31. In other words, the two coins caught on while lying side-by-side in the radial direction of the disk 31 may be coins of the smallest diameter. Note also that, the first protrusions 38 and the second protrusions 39 may also be disposed on the disk 31 such that two coins having a diameter equal to or less than a predetermined value are caught on the first protrusions 38 and the second protrusions 39 while lying side-by-side in the radial direction of the disk 31.

Figure 9:
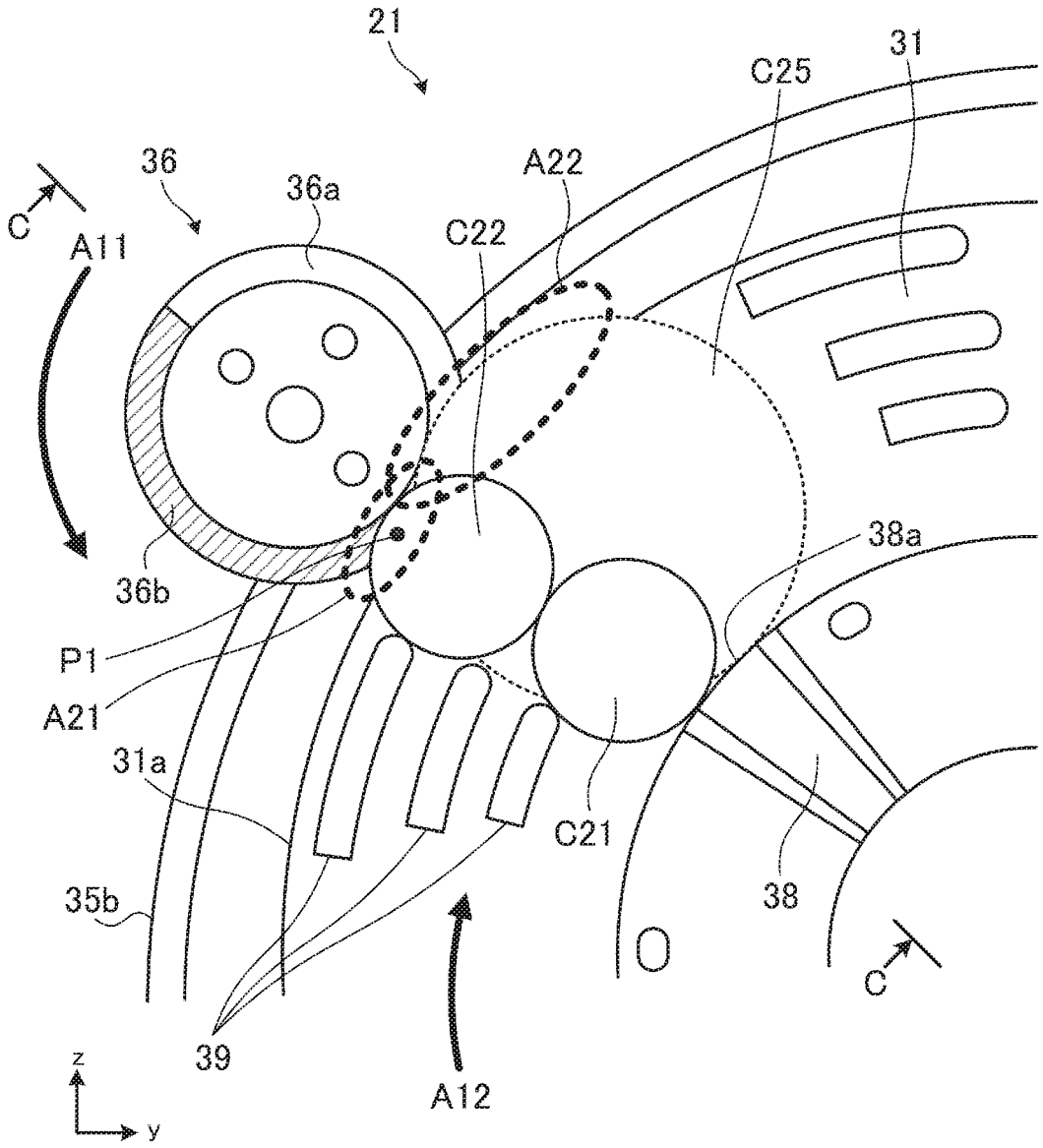
FIG. 9 is an explanatory view for explaining a principle of causing an outer coin out of two side-by-side coins to fall.

FIG. 9 is an explanatory view for explaining a principle of causing an outer coin of two side-by-side coins to fall. The same components between FIGS. 8 and 9 are provided with the same reference symbols. Note that, in FIG. 9, a coin C25 having a greater diameter than the coins C21 and C22 is indicated by the dotted line. The coin C25 cannot be caught on the disk 31 while the coins C21 and C22 are caught on the first protrusions 38 and the second protrusions 39 of the disk 31. That is, the coin C25 can alone be caught on the first protrusions 38 and the second protrusions 39 of the disk 31.

As described above, the first protrusions 38 and the second protrusions 39 are disposed on the disk 31 such that when two coins are caught on the first protrusions 38 and the second protrusions 39 while lying side-by-side in the radial direction of the disk 31, a portion of the outer coin C22 of the coins projects out from the peripheral edge 31*a* of the disk 31. For example, the portion of the outer coin C22 in a dotted frame A21 projects out from the peripheral edge 31*a* of the disk 31.

The first protrusions 38 and the second protrusions 39 are disposed on the disk 31 such that when a single coin C25 having a diameter equal to or greater than a predetermined value is caught on the first protrusions 38 and the second protrusions 39, a portion of the coin C25 projects out from the peripheral edge 31*a* of the disk 31. For example, the portion of the coin C25 in a dotted frame A22 projects out from the peripheral edge 31*a* of the disk 31. Note that, the first protrusions 38 and the second protrusions 39 may be disposed on the disk 31 such that when a single coin C25 having the greatest diameter is caught on the first protrusions 38 and the second protrusions 39, a portion of the coin C25 projects out from the peripheral edge 31*a* of the disk 31.

The portion of the coin C22 projecting out from the peripheral edge 31*a* of the disk 31 and the portion of the coin C25 projecting out from the peripheral edge 31*a* of the disk 31 project out from the disk 31 at different positions. For example, the portion of the coin C22 projecting out from the peripheral edge 31*a* of the disk 31 as indicated in the dotted frame A21 is located at a lower position than the portion of the coin C25 projecting out from the peripheral edge 31*a* of the disk 31 as indicated in the dotted frame A22. Accordingly, the portion of the coin C25 projecting out from the peripheral edge 31*a* of the disk 31 first reaches a position P1 in FIG. 9, and thereafter, the portion of the coin C22 projecting out from the peripheral edge 31*a* of the disk 31 reaches the position P1 in FIG. 9. Note that, the position P1 in FIG. 9 is a position where the portions of the coins C22 and C25 projecting out from the peripheral edge 31*a* of the disk 31 pass, and also where the lower portion 36*a* and the higher portion 36*b* of the rotating separation cam 36 pass.

As described above, the separation cam 36 rotates in synchronization with the rotation of the disk 31. For example, the separation cam 36 rotates once each time one of the first protrusions 38 passes in front of the separation cam 36. Thus, the separation cam 36 rotates in synchronization with the upward movement of the coins C22 and C25 caught on the rotating disk 31. For example, the separation cam 36 rotates such that the lower portion 36*a* is located at the position P1 when the portion of the coin C25 projecting out from the peripheral edge 31*a* of the disk 31 passes the position P1. Further, the separation cam 36 rotates such that the higher portion 36*b* is located at the position P1 when the portion of the coin C22 projecting out from the peripheral edge 31*a* of the disk 31 passes the position P1.

The surface of the lower portion 36*a* of the separation cam 36 is flush with or lower than the surface of the disk 31.

When the coin C25 passes the position P1, the lower portion 36*a* of the separation cam 36 is located at the position P1. Thus, the coin C25 passes the position P1 without making contact with the separation cam 36, and is carried upward steadily.

The surface of the higher portion 36*b* of the separation cam 36 is higher than the surface of the disk 31. When the coin C22 passes the position P1, the higher portion 36*b* of the separation cam 36 is located at the position P1. Thus, of the two coins C21 and C22, the outer coin C22 makes contact with the higher portion 36*b* of the separation cam 36, is scooped up from the surface of the disk 31, and is separated from the disk 31. The coin C22 separated from the disk 31 falls into the space A1, and the coin C21 remains on the disk 31.

As described above, the first protrusions 38 and the second protrusions 39 are disposed on the surface of the disk 31 such that a portion of the outer coin C22 of the two side-by-side coins C21 and C22 projects out from the peripheral edge 31*a* of the disk 31. The separation cam 36 does not make contact with the coin C25, but makes contact with the portion of the coin C22 projecting out from the peripheral edge 31*a* of the disk 31, so as to cause the coin C22 to fall into the space A1. The portion of the coin C22 projecting out from the peripheral edge 31*a* of the disk 31 and the portion of the coin C25 projecting out from the peripheral edge 31*a* of the disk 31 project out from the disk 31 at different positions as indicated in the dotted frames A21 and A22.

Further, the separation cam 36 includes the higher portion 36*b* that moves between a first position (position P1) where the higher portion 36*b* makes contact with a portion of the coin C22 and a second position where the higher portion 36*b* does not make contact with the portion of the coin C25 projecting out from the peripheral edge 31*a* of the disk 31. The higher portion 36*b* moves to the position P1 when the portion of the coin C22 projecting out from the peripheral edge 31*a* of the disk 31 passes the position P1. The higher portion 36*b* moves to the second position (for example, the position illustrated in FIG. 10) when the portion of the coin C25 projecting out from the peripheral edge 31*a* of the disk 31 passes the position P1. The single coin C25 carried upward by the disk 31 is thus carried upward steadily, and is fed to the guide 32. Of the two coins C21 and C22 carried upward by the disk 31, the coin C22 is separated from the disk 31 by the separation cam 36 and falls into the space A1.

Figure 10:
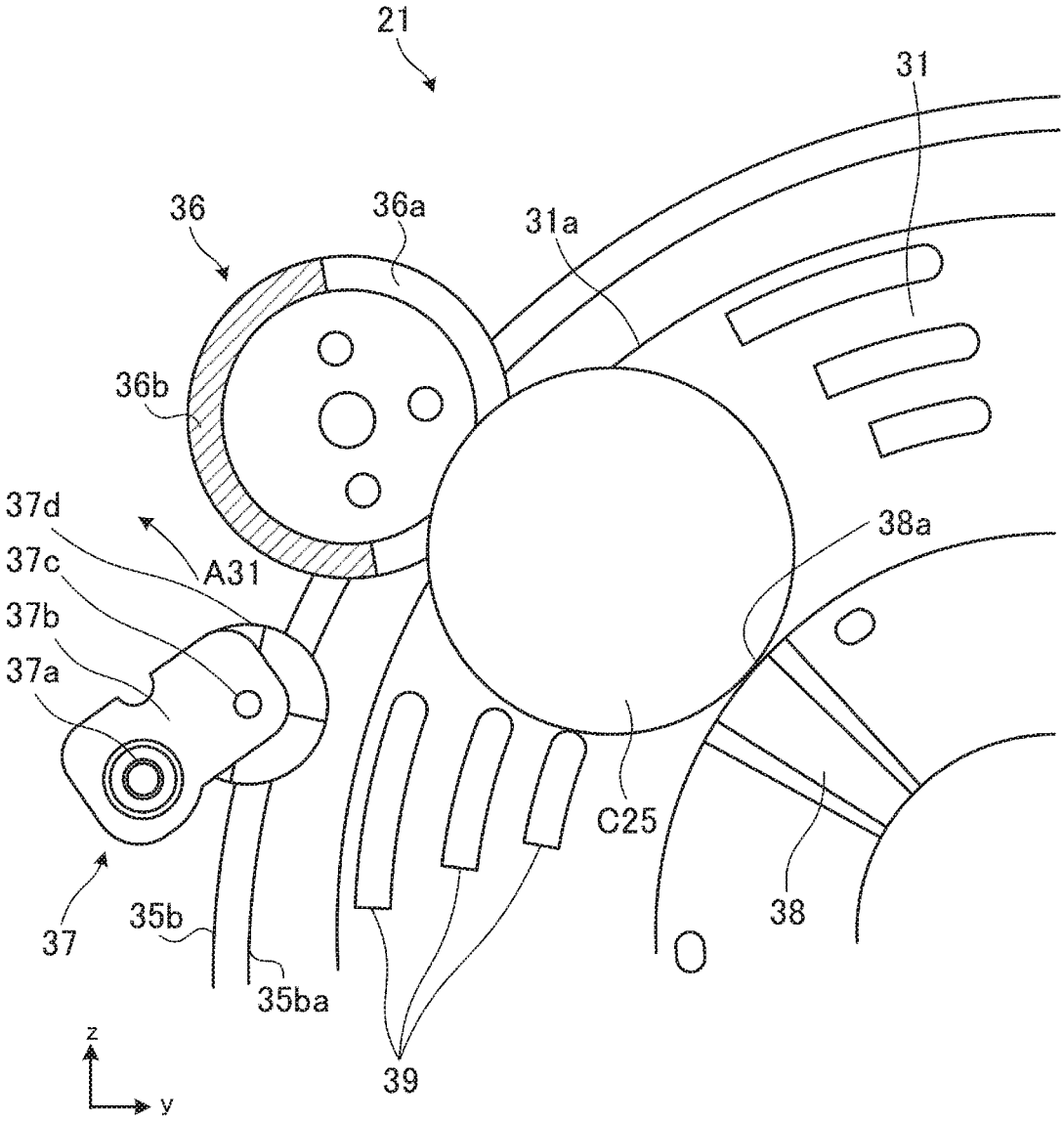
FIG. 10 is an explanatory view for explaining a pushing-aside lever.

FIG. 10 is an explanatory view for explaining the pushing-aside lever 37. The same components between FIG. 10 and FIGS. 6 to 9 are provided with the same reference symbols.

The coin C25 is sometimes carried upward while in contact with the inner side 35*ba* of the side wall 35*b* of the cover 35 when caught on and carried upward by the second protrusions 39 of the disk 31. The bearing 37*d* of the pushing-aside lever 37 makes contact with the coin C25 that is carried upward while in contact with the inner side 35*ba* of the side wall 35*b*, and pushes aside the coin C25 toward the surface 38*a* of one of the first protrusions 38 (causes the coin C25 to be placed on the surface 38*a* of one of the first protrusions 38). The coin C25 is caused to be placed on the surface 38*a* of one of the first protrusions 38 and, therefore, is carried upward stably and steadily.

The pushing-aside lever 37 is disposed on the housing of the coin feeding apparatus 21 so as to be rotatable in the direction of an arrow A31 in FIG. 10 about the shaft 37*a* serving as a central axis. The pushing-aside lever 37 is adapted to return to the position illustrated in FIG. 10, for example, by a torsion spring (not illustrated) even when rotated in the direction of the arrow A31. Even when an excessive force is applied to the pushing-aside lever 37, the pushing-aside lever 37 escapes in the direction of the arrow A31, so that it is possible to reduce damage or the like to the pushing-aside lever 37.

Figure 11:
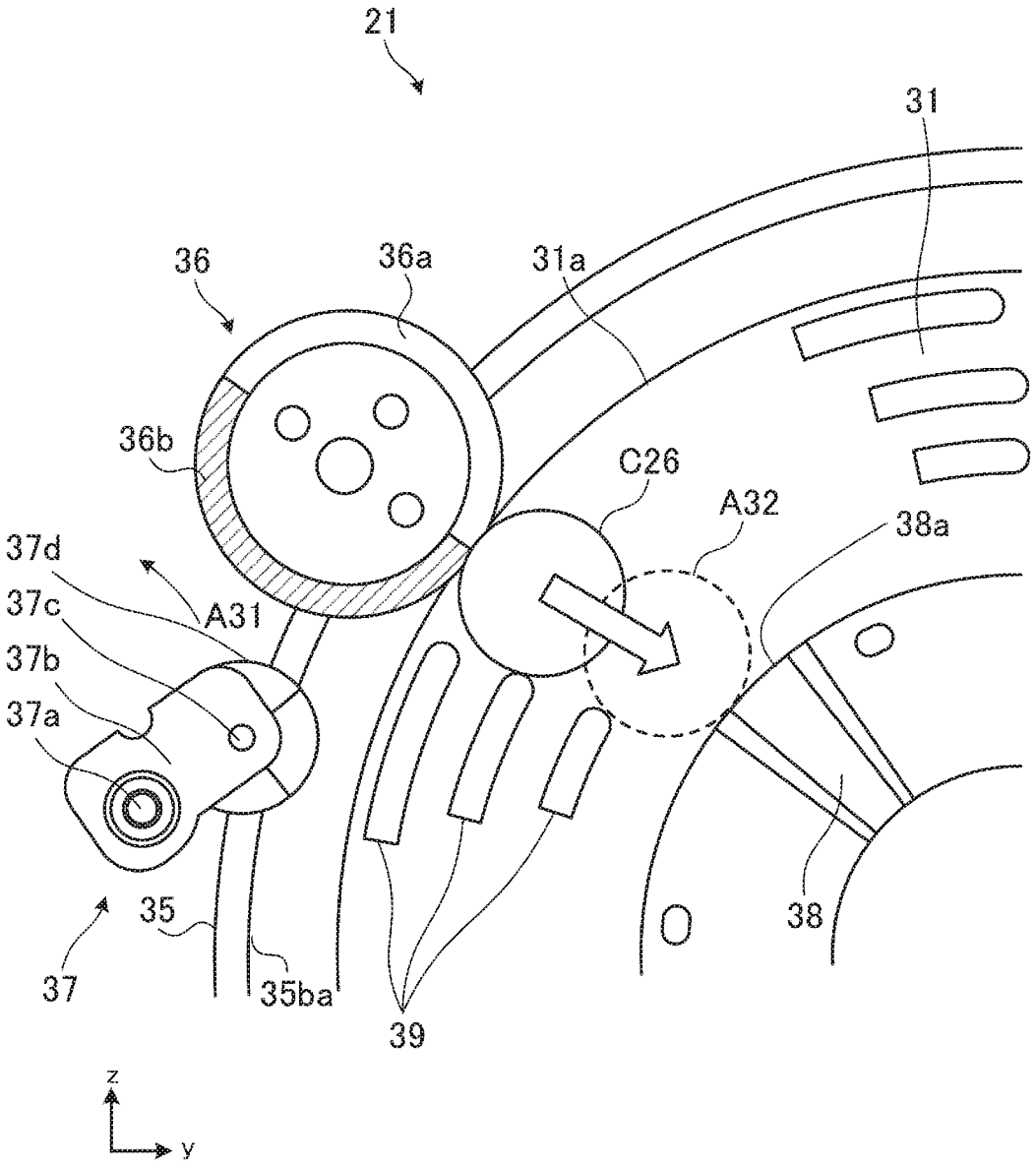
FIG. 11 is an explanatory view for explaining a case in which a single small-diameter coin is caught on and carried upward by a disk.

FIG. 11 is an explanatory view for explaining a case in which a single small-diameter coin is caught on and carried upward by the disk. The same components between FIGS. 10 and 11 are provided with the same reference symbols. FIG. 11 illustrates a coin C26 having a smaller diameter than the coin C25 illustrated in FIG. 10.

The coin C26 is sometimes carried upward while in contact with the inner side 35*ba* of the side wall 35*b* of the cover 35 when caught on and carried upward by the second protrusions 39 of the disk 31. When the coin C26 has a small diameter, the bearing 37*d* of the pushing-aside lever 37 is sometimes unable to push aside the coin C26 toward the surface 38*a* of one of the first protrusions 38 even when making contact with the coin C26.

The coin C26 which has not been pushed aside toward the surface 38*a* of the first protrusion 38 by the pushing-aside lever 37 comes into contact with the higher portion 36*b* of the separation cam 36 when carried upward steadily. The coin C26 having come into contact with the higher portion 36*b* is pushed aside toward the surface 38*a* of the first protrusion 38 as illustrated by a dotted line A32 in FIG. 11.

The coin C22 illustrated in FIG. 9 also makes contact with the higher portion 36*b* of the separation cam 36 as described with reference to FIG. 9. However, since the coin C21 exists in FIG. 9, the coin C22 is not pushed aside toward (not moved to) the surfaces 38*a* of the first protrusions 38. The coin C22 in FIG. 9 is thus scooped up by the separation cam 36 from the disk 31, and falls into the space A1. In contrast, in FIG. 11, the coin C26 alone is caught on the second protrusions 39. Accordingly, the coin C26 coming into contact with the higher portion 36*b* of the separation cam 36 is pushed aside to the surface 38*a* of the first protrusion 38.

As described above, the two coins caught on the disk 31 are reduced to one coin by the separation cam 36. Then, the coin is singly fed to the guide 32 (see the coin C3 in FIG. 2). However, the two coins caught on the disk 31 are sometimes not reduced to one coin even by the separation cam 36. For example, the coin C22 illustrated in FIG. 9 is sometimes not properly scooped up by the separation cam 36. In this case, two coins are fed to the guide 32 side by side (see FIG. 17A). In order to deal with this, the separation disk 33 illustrated in FIGS. 2 and 6 causes one coin of the two coins fed to the guide 32 to fall into the space A1.

Figure 12:
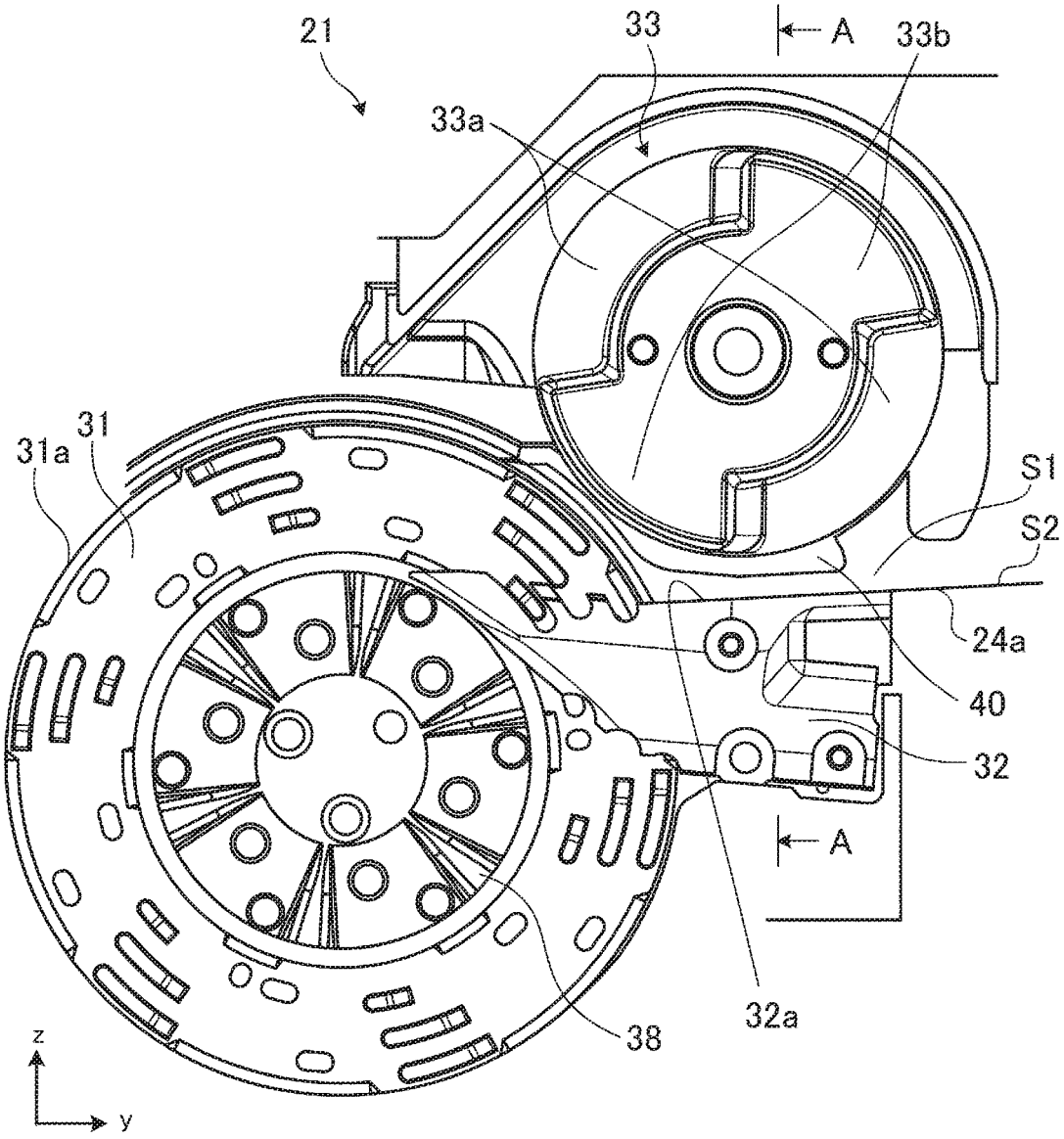
FIG. 12 illustrates a portion of the coin feeding apparatus as seen from the surface side of the disk.

FIG. 12 illustrates a portion of the coin feeding apparatus 21 as seen from the surface side of the disk 31. The same components between FIGS. 6 and 12 are provided with the same reference symbols. Note that, the side surface S1 and the bottom surface S2 of the transport path 24*a* described in FIG. 5 are illustrated in FIG. 12.

The guide 32 is disposed on the upper-half side of the disk 31 so as to overlap the disk 31. The guide 32 is disposed on the disk 31 on the side where the peripheral edge of the rotating disk 31 descends. For example, the disk 31 rotates clockwise in FIG. 12. The peripheral edge of the disk 31 on its right half descends and the peripheral edge on its left half ascends. Thus, in FIG. 12, the guide 32 is disposed on the right-half side of the disk 31.

The separation disk 33 is disposed in the periphery of the disk 31 and above the guide 32. The separation disk 33, like the disk 31, is disposed on the housing of the coin feeding apparatus 21 to be inclined. The separation disk 33 includes flat lower portions 33*a*, and a flat higher portion 33*b* higher than the lower positions as illustrated in FIG. 12.

Figure 13:
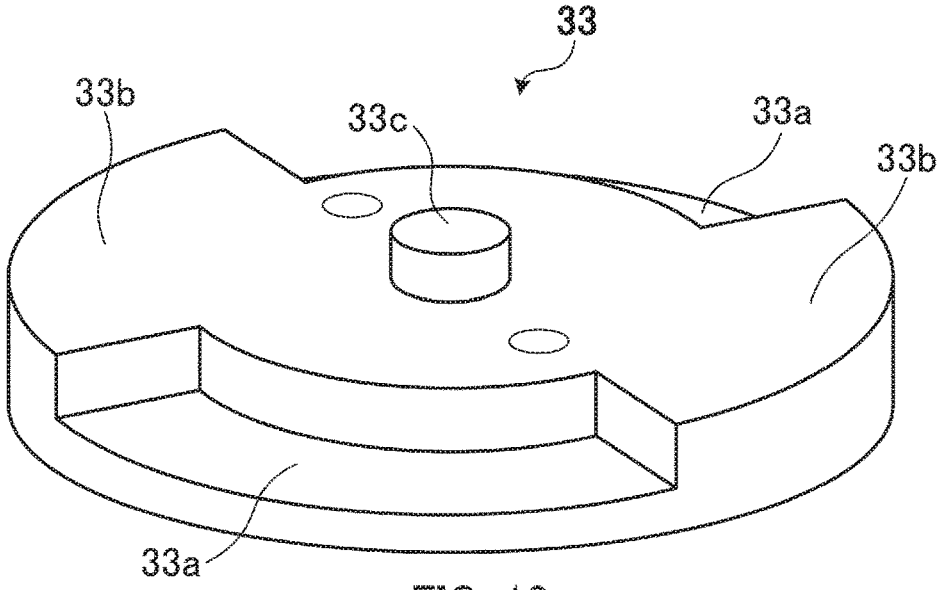
FIG. 13 is a perspective view of a separation disk.

FIG. 13 is a perspective view of the separation disk 33. The separation disk 33 illustrated in FIG. 13 is partially modified in shape or the like in comparison with the separation disk 33 illustrated in FIG. 12. The same components between FIGS. 12 and 13 are provided with the same reference symbols.

The separation disk 33 has a substantially cylindrical shape. The separation disk 33 includes, at its cylindrical end surface, the flat lower portions 33*a*, the flat higher portion 33*b* that is higher than the lower portions 33*a*, and a protrusion 33*c* disposed on the higher portion 33*b*. The lower portions 33*a* are fan-shaped and located at two positions in the peripheral edge of the separation disk 33. The lower portions 33*a* are formed at positions symmetrical with respect to the center of the separation disk 33.

The protrusion 33*c* is disposed at the central portion of the separation disk 33. The pulley 34 illustrated in FIG. 3 is attached to the protrusion 33*c*. That is, the pulley 34 is attached so as to overlap the upper surface of the separation disk 33. Note that there is a gap between the pulley 34 and the separation disk 33 (see the space between the separation disk 33 and the pulley 34 in FIG. 14).

A description will be given with reference to FIG. 12 again. The separation disk 33 rotates counterclockwise in FIG. 12. The separation disk 33 rotates in synchronization with the rotation of the disk 31. For example, the separation disk 33 rotates once each time the disk 31 rotates 120 degrees. In other words, one of the two lower portions 33*a* of the separation disk 33 approaches the guide 32 each time one of the first protrusions 38 passes the guide 32.

The rotation of the separation disk 33 causes the pulley 34 (see FIGS. 3 and 14) disposed on the upper surface of the separation disk 33 to also rotate. The belt 23 having the pins 23*a* (see the belt 23 and the pins 23*a* in FIGS. 2 and 5) is wound on the pulley 34. The momentum caused by the rotation of the disk 31 causes a coin placed on the upper surface 32*a* of the guide 32 to travel toward the transport path 24*a*. Then, the coin placed on the upper surface 32*a* of the guide 32 passes through the gap between the separation disk 33 and the pulley 34, and the rear of the circumferential surface of the coin is pushed by one of the pins 23*a* of the belt 23, so that the coin is transported on the transport path 24*a*.

The upper surface 32*a* of the guide 32 is connected to the bottom surface S2 of the transport path 24*a*. The side surface S1 of the transport path 24*a* is formed also at an upper portion of the upper surface 32*a* of the guide 32, and extends to the vicinity of the peripheral edge 31*a* of the disk 31. The side surface S1 is flush with (at the same height as) the surface of the higher portion 33*b* of the separation disk 33. Note that "the same" may include "substantially the same."

The coin feeding apparatus 21 comprises a recess 40 in the periphery of the separation disk 33. The recess 40 may be considered to be formed in the side surface S1 of the transport path 24*a*. The recess 40 is recessed from the side surface S1 of the transport path 24*a* (the recess 40 is lower than the side surface S1). The surfaces of the lower portions 33*a* of the separation disk 33 are flush with the recess 40 or are lower than the surface of the recess 40.

Figure 14:
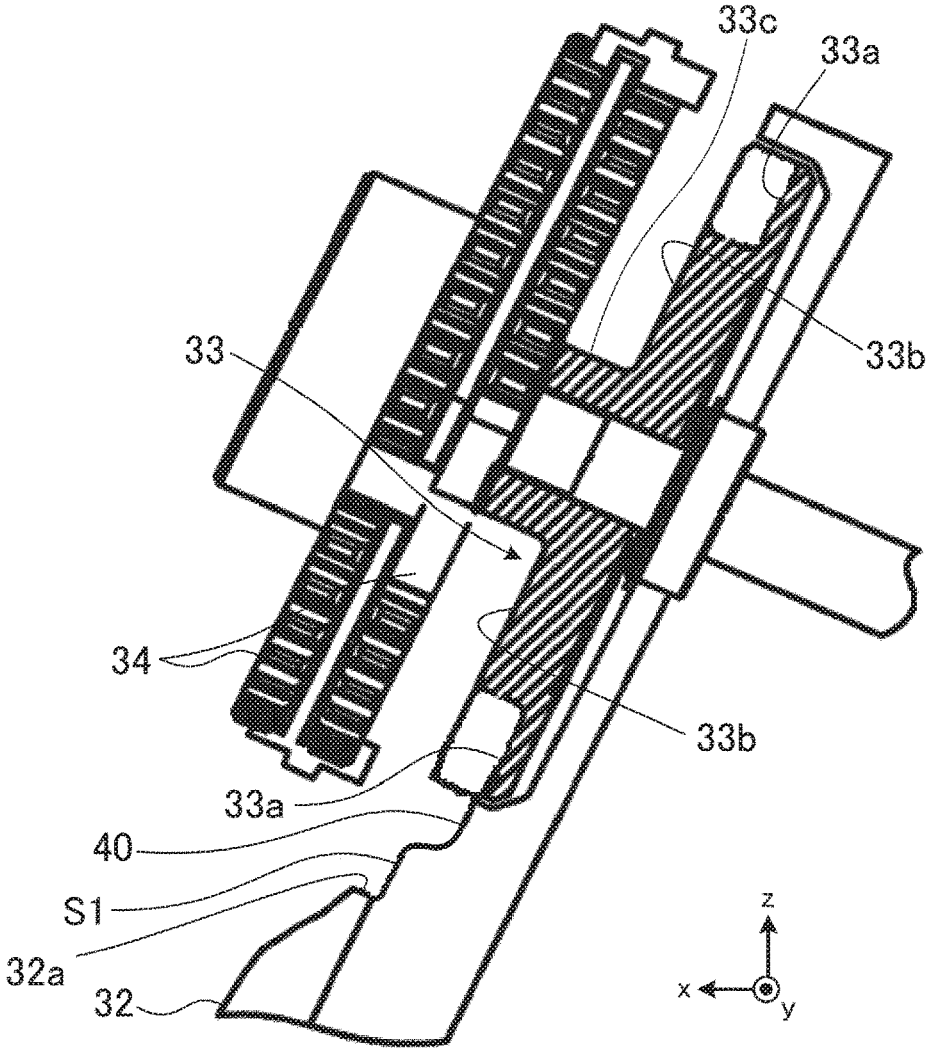
FIG. 14 is a sectional view taken along a line A-A and seen in a direction of arrows A in FIG. 12.

FIG. 14 is a sectional view taken along a line A-A and seen in a direction of arrows A in FIG. 12. The same components between FIGS. 12 and 14 are provided with the same reference symbols. Note that FIG. 14 also illustrates the pulley 34.

As illustrated in FIG. 14, the side surface S1 of the transport path 24*a* is at the same height as the surface of the higher portion 33*b* of the separation disk 33. The surface of the recess 40 is lower than the side surface S1 of the transport path 24*a*. The bottom surface of the recess 40 is at the same height as the surfaces of the lower portions 33*a* of the separation disk 33. The upper surface 32*a* of the guide 32 forms a substantially 90 degrees with the side surface S1 of the transport path 24*a*. The inclination angle of the side surface S1 of the transport path 24*a* is the same as the inclination angle of the separation disk 33.

Figure 15:
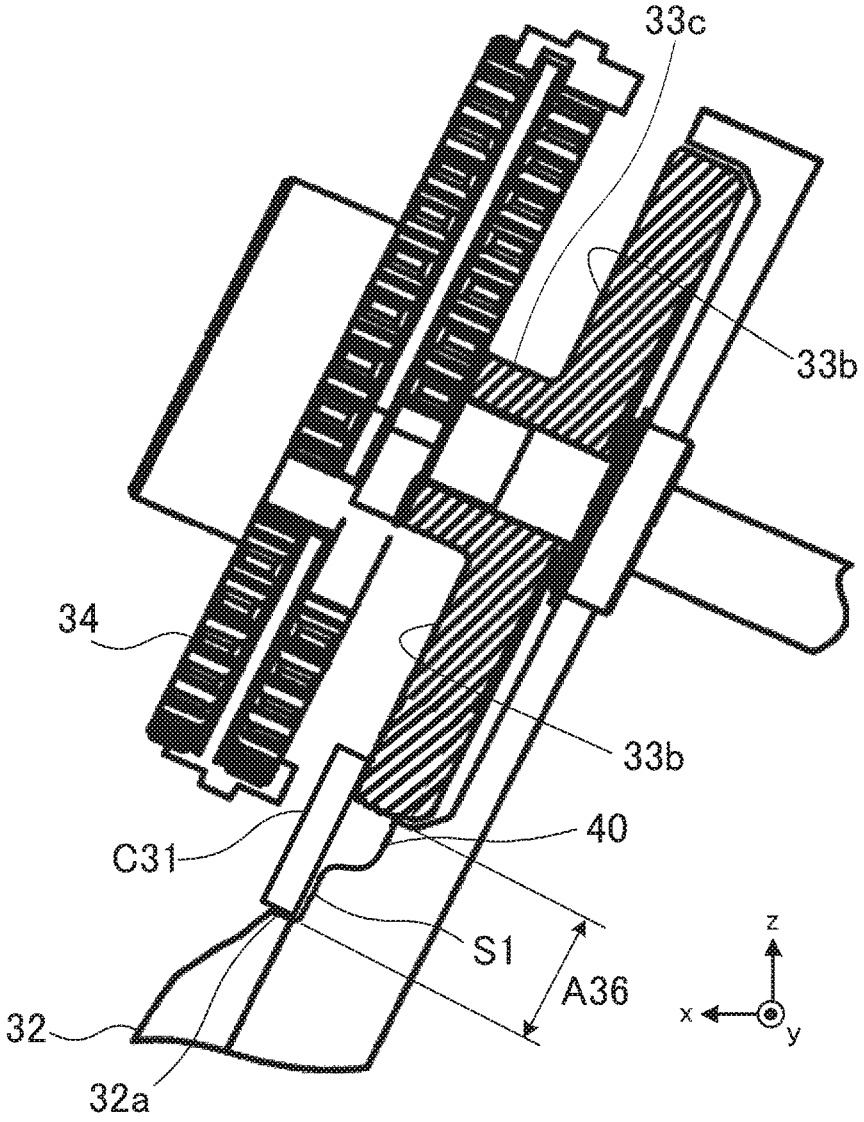
FIG. 15 illustrates a state in which a coin traveling on a guide is sent to the transport path.

FIG. 15 illustrates a state in which a coin C31 traveling on the guide 32 is sent to the transport path 24*a*. The same components between FIGS. 14 and 15 are provided with the same reference symbols. The coin C31 is, for example, a coin having the smallest diameter among coins handled by the money handling apparatus 1. In FIG. 15, the separation disk 33 has rotated to the extent that the higher portion 33*b* is located at the lowest point.

As indicated by a double-headed arrow A36 in FIG. 15, the distance from the upper surface 32*a* of the guide 32 to the higher portion 33*b* of the separation disk 33 is smaller than the diameter of the coin C31. Thus, the upper end of the peripheral edge of the coin C31 placed on the upper surface 32*a* of the guide 32 makes contact with the higher portion 33*b* of the separation disk 33.

The surface of the higher portion 33*b* of the separation disk 33 is at the same height as the surface of the side surface S1 of the transport path 24*a*. Thus, the inclination angle of the coin C31 is maintained at the inclination angle of the coin C31 transported through the transport path 24*a* (the inclination angle of the coin C4 illustrated in FIG. 5). Thus, the coin C31 on the guide 32 does not fall into the space A1, and is sent to the transport path 24*a*.

Figure 16:
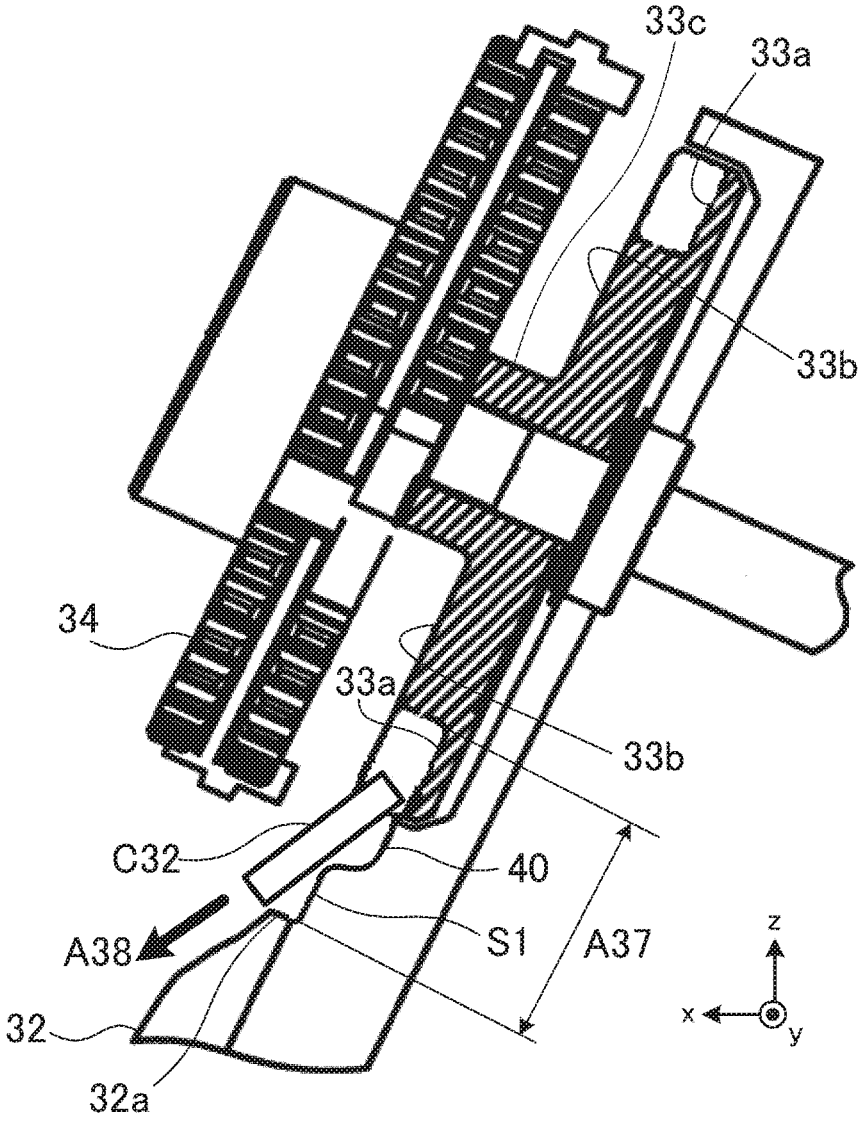
FIG. 16 illustrates a state in which a coin traveling on the guide falls.

FIG. 16 illustrates a state in which a coin C32 traveling on the guide 32 falls. The same components between FIGS. 14 and 16 are provided with the same reference symbols. The coin C32 is, for example, a coin having the smallest diameter among coins handled by the money handling apparatus 1. In FIG. 16, the separation disk 33 has rotated to the extent that one of the lower portions 33*a* is located at the lowest point.

As indicated by a double-headed arrow A37 in FIG. 16, the distance from the upper surface 32*a* of the guide 32 to the edge of one of the lower portions 33*a* of the separation disk 33 (a portion of the separation disk 33 where the lower portion 33*a* ends and the higher portion 33*b* starts) is greater than the diameter of the coin C31. Thus, the upper end of the peripheral edge of the coin C32 comes into contact with the lower portion 33*a* of the separation disk 33. Note that, the distance indicated by the double-headed arrow A37 only has to be greater than the diameters of two coins that can be transported on the guide 32 side by side.

The surfaces of the lower portions 33*a* of the separation disk 33 are lower than the surface of the side surface S1 of the transport path 24*a*. Thus, the inclination angle of the coin C32 increases, so that the lower end of the coin C32 comes off the upper surface 32*a* of the guide 32. The coin C32 having come off the upper surface 32*a* of the guide 32 falls into the space A1 as indicated by an arrow A38 in FIG. 16.

FIGS. 17A to 17F are explanatory views for explaining a fall of a coin caused by the separation disk 33. The same components between FIGS. 17A to 17F and FIGS. 12 to 16 are provided with the same reference symbols. The separation disk 33 and the like illustrated in FIGS. 17A to 17F are partially modified in shape or the like in comparison with the separation disk 33 and the like illustrated in FIGS. 12 to 16.

A position P2 is illustrated in FIGS. 17A to 17F. The position P2 indicates a position where, of two coins C51 and C52 sent to travel on the guide 32 side by side, the leading coin C51 falls off the guide 32.

Figure 17A:
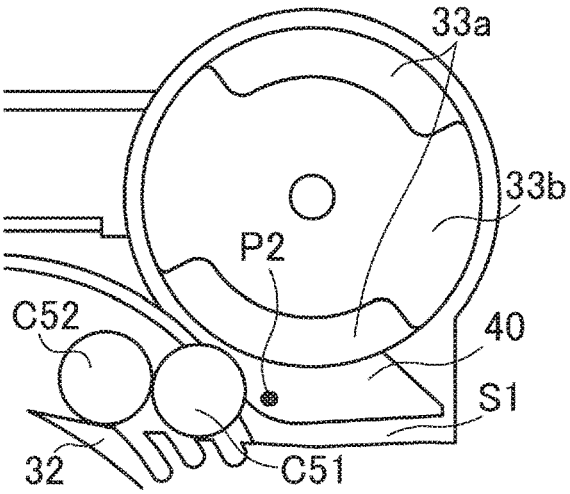
FIG. 17A is an explanatory view for explaining a fall of a coin caused by the separation disk.

As illustrated in FIG. 17A, two coins C51 and C52 are sometimes fed onto the guide 32 side by side. When the two coins C51 and C52 are transported side by side on the transport paths 24*a* and 24*c*, the coins sometimes cannot be appropriately sorted (separated) by the sorting units. As will be described with reference to FIGS. 17B to 17F, the separation disk 33 causes, to come off the guide 32 to fall into the space A1, the leading coin C51 of the two coins C51 and C52 fed side by side onto the guide 32.

Figure 17B:
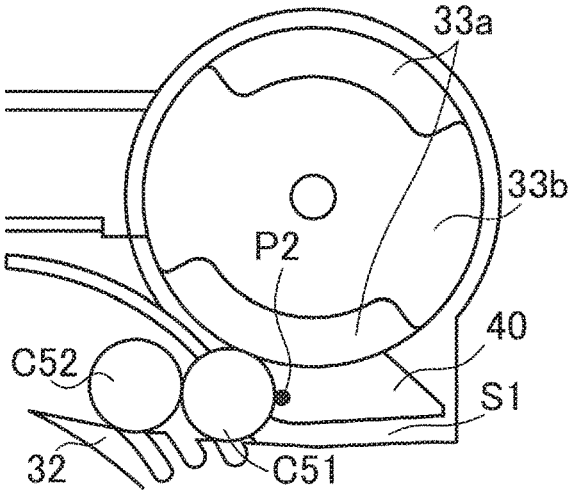
FIG. 17B is an explanatory view for explaining the fall of the coin caused by the separation disk.

The coins C51 and C52 on the guide 32 illustrated in FIG. 17B have moved farther toward the transport path 24*a* than the coins C51 and C52 illustrated in FIG. 17A. In addition, the separation disk 33 illustrated in FIG. 17B has rotated counterclockwise more than the separation disk 33 illustrated in FIG. 17A.

In FIG. 17B, one of the lower portions 33*a* of the separation disk 33 is located above the position P2. The leading coin C51 located in front of the position P2 is supported by the disk 31 and the side surface S1. Therefore, the leading coin C51 does not fall from the guide 32.

Figure 17C:
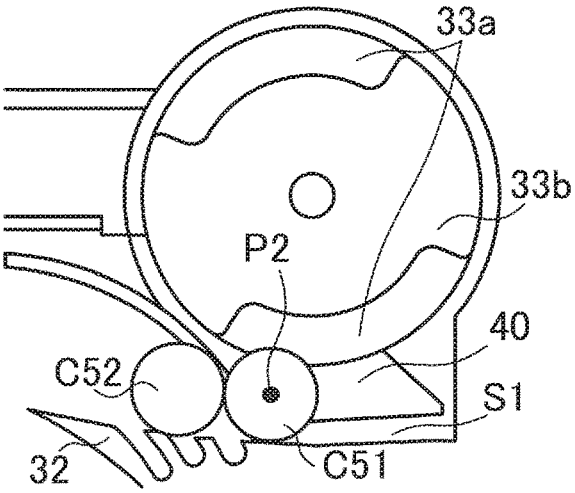
FIG. 17C is an explanatory view for explaining the fall of the coin caused by the separation disk.

The coins C51 and C52 on the guide 32 illustrated in FIG. 17C have moved farther toward the transport path 24*a* than the coins C51 and C52 illustrated in FIG. 17B. In addition, the separation disk 33 illustrated in FIG. 17C has rotated counterclockwise more than the separation disk 33 illustrated in FIG. 17B.

In FIG. 17C, one of the lower portions 33*a* of the separation disk 33 is located above the position P2. The center of the leading coin C51 is located at the position P2. The upper end of the leading coin C51 whose center is located at the position P2 is inclined toward the lower portion 33*a* of the separation disk 33 (see the coin C32 in FIG. 16). Thus, the lower end of the leading coin C51 comes off the guide 32. Note that, the area of the coin C51 supported by the side surface S1 (the area of the coin C51 in contact with the side surface S1) is equal to or less than half of the area of the coin C51.

Figure 17D:
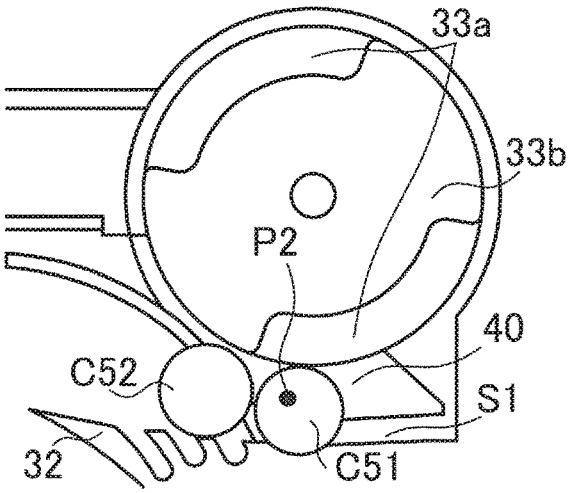
FIG. 17D is an explanatory view for explaining the fall of the coin caused by the separation disk.

The coin C52 on the guide 32 illustrated in FIG. 17D has moved farther toward the transport path 24*a* than the coin C52 illustrated in FIG. 17C. In addition, the separation disk 33 illustrated in FIG. 17D has rotated counterclockwise more than the separation disk 33 illustrated in FIG. 17C. In FIG. 17D, the leading coin C51 having come off the upper surface 32*a* of the guide 32 is falling toward the space A1.

Figure 17E:
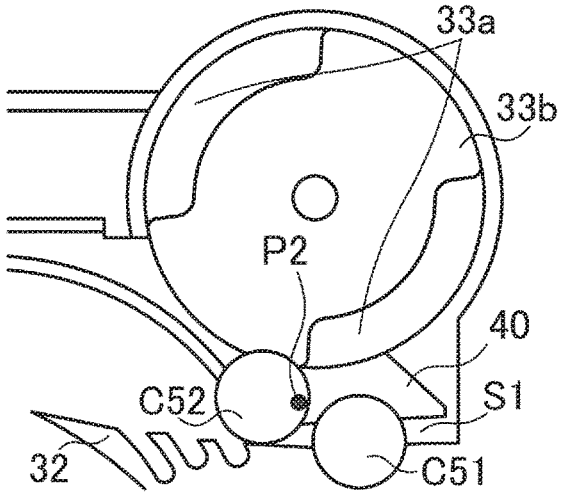
FIG. 17E is an explanatory view for explaining the fall of the coin caused by the separation disk.

The coin C52 on the guide 32 illustrated in FIG. 17E has moved farther toward the transport path 24*a* than the coin C52 illustrated in FIG. 17D. In addition, the separation disk 33 illustrated in FIG. 17E has rotated counterclockwise more than the separation disk 33 illustrated in FIG. 17D.

In FIG. 17E, the higher portion 33*b* of the separation disk 33 is located above the position P2. The leading end of the coin C52 is located at the position P2. The upper end of the coin C52 whose leading end is located at the position P2 is supported by the higher portion 33*b* of the separation disk 33 (see the coin C31 in FIG. 15). Thus, the transport angle of the coin C52 (e.g., the inclination angle of the side surface S1 illustrated in FIG. 5) is maintained, and the coin C52 does not come off the guide 32.

Figure 17F:
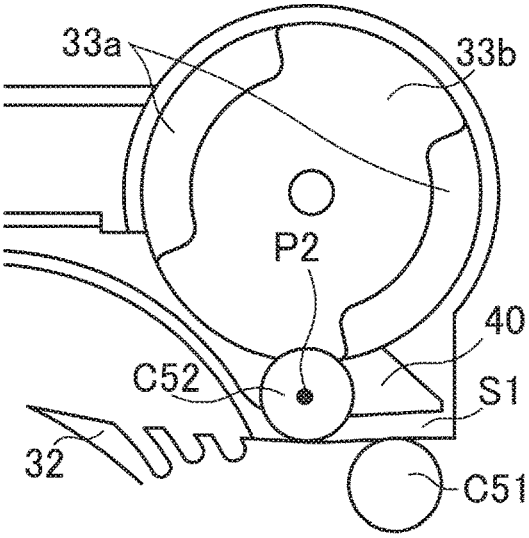
FIG. 17F is an explanatory view for explaining the fall of the coin caused by the separation disk.

The coin C52 on the guide 32 illustrated in FIG. 17F has moved farther toward the transport path 24*a* than the coin C52 illustrated in FIG. 17E. In addition, the separation disk 33 illustrated in FIG. 17F has rotated counterclockwise more than the separation disk 33 illustrated in FIG. 17E.

In FIG. 17F, the higher portion 33*b* of the separation disk 33 is located above the position P2. The center of the coin C52 is located at the position P2. The upper end of the coin C52 whose center is located at the position P2 is supported by the higher portion 33*b* of the separation disk 33 (see the coin C31 in FIG. 15). Thus, the transport angle of the coin C52 is maintained, and the coin C52 does not come off the guide 32. Note that, the coin C52 is supported by the higher portion 33*b* of the separation disk 33 until the coin C52 is sent to the transport path 24*a*. That is, of the two coins C51 and C52 fed side by side to the guide 32, the leading coin C51 falls into the space A1, whereas the rear coin C52 is sent to the transport path 24*a*.

As described above, the separation disk 33 changes the inclination angle of the leading coin C51 so as to cause the leading coin C51 to come off the guide 32 and fall into the space A1. The separation disk 33 includes the lower portions 33*a* for changing the inclination angle of the leading coin C51 from a predetermined angle (transport angle), and the higher portion 33*b* for maintaining the inclination angle of the rear coin C52. The lower portions 33*a* and the higher portion 33*b* of the separation disk 33 alternately arrive at the position P2 in synchronization with the rotation of the disk 31. The lower portions 33*a* arrive at the position P2 when the leading coin C51 passes the position P2, and change the inclination angle of the leading coin C51 from the transport angle so as to cause the leading coin C51 to fall into the space A1. The higher portion 33*b* arrives at the position P2 when the rear coin C52 passes the position P2, and maintains the inclination angle of the rear coin C52 at the transport angle so as to cause the rear coin C52 to pass the guide 32.

Thus, of the two coins C51 and 52 transported on the guide 32 side by side, the front coin C51 is caused to fall into the space A1, while the rear coin C52 is sent to the transport path 24*a*. Note that, the guide 32 transports coins separated from the disk 31. Note also that, the upper surface 32*a* of the guide 32 is connected to the transport path 24*a*. Thus, the guide 32 may be regarded as a part of the transport path 24*a*. The guide 32 may also be regarded as a part that separates coins on the transport path 24*a* from the disk 31.

Figure 18:
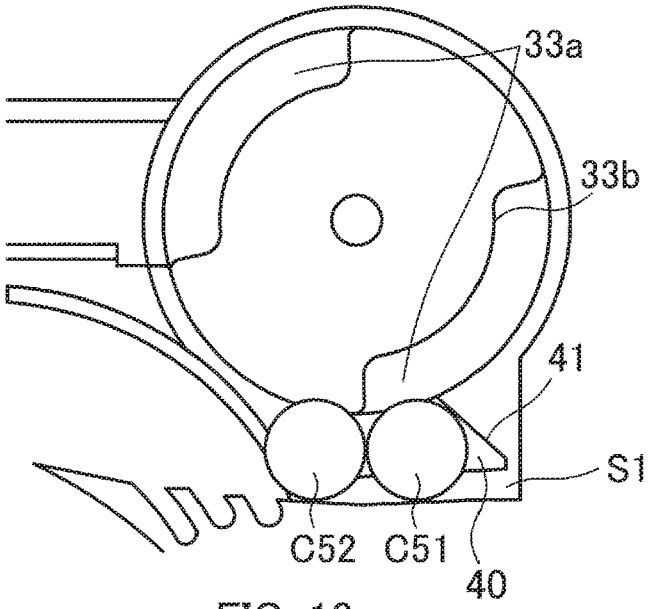
FIG. 18 is an explanatory view for explaining a structure for improving the fall of a leading coin.

FIG. 18 is an explanatory view for explaining a structure for improving the fall of the leading coin C51. The same components between FIGS. 17 and 18 are provided with the same reference symbols.

As illustrated in FIG. 18, a notch 41 is formed in the recess 40. The notch 41 makes contact with the peripheral edge of the leading coin C51 whose inclination angle has been changed, and stops the leading coin C51. The notch 41 includes a surface formed as if it is folded back in a direction opposite to the transport direction of the coin C51 and formed to make contact with the peripheral edge of the leading coin C51.

With this notch 41, the coin feeding apparatus 21 ensures that the coin C51 falls into the space A1. For example, the coin C51 caused to fall by the separation disk 33 sometimes moves toward the transport path 24*a* by a propulsion force even when the inclination angle is changed by the separation disk 33. The notch 41 ensures that such a coin C51 falls into the space A1.

As described above, the coin feeding apparatus 21 comprises: the disk 31 that includes the first protrusions 38 and the second protrusions 39 on the surface of the disk 31, is disposed to be inclined and rotatable, and, when rotating, causes a first coin or a second coin to be caught on and carried by the first protrusions 38 and the second protrusions 39, the second coin having a diameter greater than that of the first coin; the cover 35 that forms, between the cover 35 and the surface of the disk 31, the space A1 for storing a coin therein; and the separation cam 36 that separates the outer coin out of two of the first coins from the first protrusions 38 and the second protrusions 39 so as to cause the outer coin to fall into the space A1, the two first coins being caught on the first protrusions 38 and the second protrusions 39 while lying side-by-side in the radial direction of the disk 31. Thus, the coin feeding apparatus 21 is capable of feeding to transport path 24*a* the stored coins ranging from a coin of small diameter to a coin of a large diameter one by one.

In addition, the coin feeding apparatus 21 comprises: the transport path 24*a* that causes a coin caught on and carried upward by the first protrusions 38 and the second protrusions 39 to come off the first protrusions 38 and the second protrusions 39, and transports the coin while maintaining the coin at a predetermined inclination angle; and the separation disk 33 that causes, to come off the transport path 24*a* to fall into the space A1, a leading coin of two coins transported side by side on the transport path 24*a*. The coin feeding apparatus 21 is capable of feeding to the transport path 24*a* the stored coins ranging from a coin of small diameter to a coin of large diameter one by one.

Embodiment 2

Embodiment 2 will be described in relation to an example of a coin feeding apparatus of such a type that coins are fed using centrifugal force.

Figure 19:
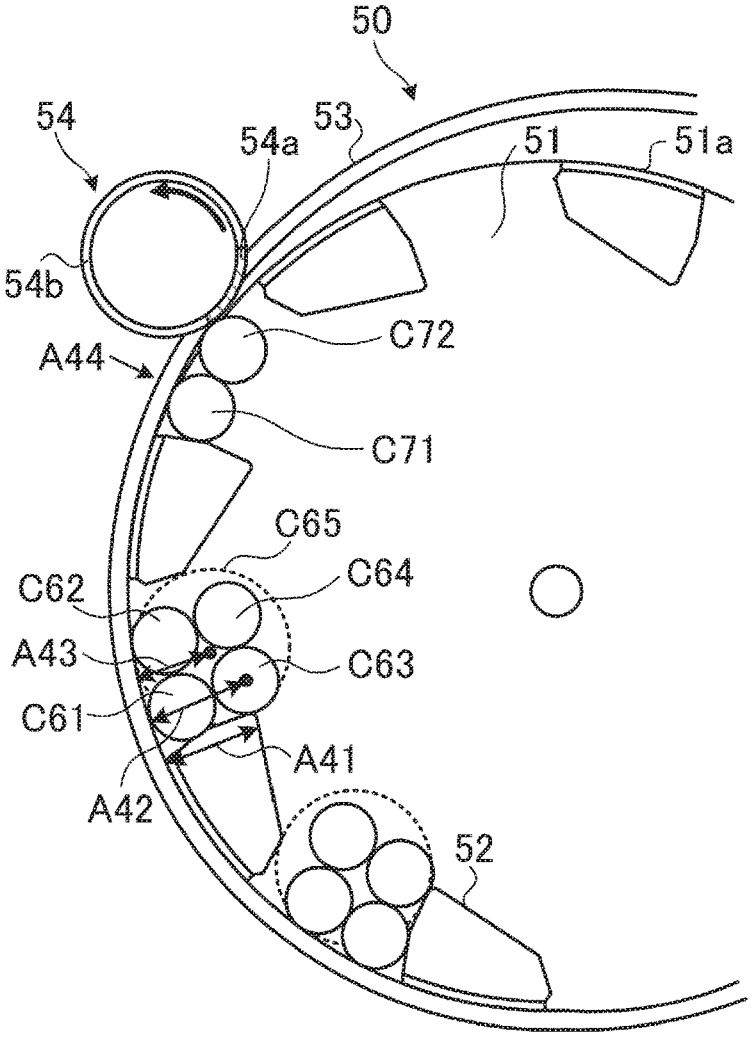
FIG. 19 illustrates a portion of a coin feeding apparatus according to Embodiment 2 as seen from the surface side of the disk.

FIG. 19 illustrates a portion of a coin feeding apparatus 50 according to Embodiment 2 as seen from the surface side of a disk 51. As illustrated in FIG. 19, the coin feeding apparatus 50 comprises a disk 51, protrusions 52, a cover 53, and a separation cam 54.

The disk 51 is inclined at a predetermined angle with respect to the vertical direction. The disk 51 rotates clockwise in FIG. 19, for example. The disk 51 rotates at such a speed that stored coins move in the radial direction of the disk 51 by the centrifugal force.

The protrusions 52 are disposed on the surface of the disk 51. For example, eight protrusions 52 are disposed on the peripheral edge 51*a* of the disk 51 (FIG. 19 illustrates five of the eight protrusions 52). The protrusions 52 may be disposed such that two coins having the smallest diameter lying side-by-side in the circumferential direction are caught on the protrusions 52. The protrusions 52 may also be disposed on the disk 51 such that two coins having a diameter equal to or less than a predetermined value lying side-by-side in the circumferential direction of the disk 51 are caught on the protrusions 52.

The cover 53 is disposed on the coin feeding apparatus 50 to cover the surface of the disk 51. The cover 53 forms, between the cover 53 and the surface of the disk 51, a space for storing therein coins deposited from the inlet 11. The cover 53, like the cover 35 in the description of Embodiment 1, includes a side wall disposed along the peripheral edge 51*a* of the disk 51, and a side wall disposed to diverge from the peripheral edge 51*a* of the disk 51 with decreasing distance to the separation cam 54. For example, a portion of the cover 53 on one side from a boundary indicated by an arrow A44 in FIG. 19 diverges from the peripheral edge 51*a* of the disk 51.

The separation cam 54 has, for example, the same shape as the separation cam 36 illustrated in FIG. 7. The separation cam 54 includes a lower portion 54*a* and a higher portion 54*b*. In FIG. 19, the lower portion 54*a* is indicated by hatching such that the lower portion 54*a* is easily distinguished from the higher portion 54*b*.

The separation cam 54 rotates counterclockwise in FIG. 19. The separation cam 54 rotates in synchronization with the disk 51. The separation cam 54 rotates once each time one of the protrusions 52 passes in front of the separation cam 54. In the example of FIG. 19, eight protrusions 52 are disposed on the disk 51, and the separation cam 54 thus rotates once each time the disk 51 rotates 45 degrees.

Coins C61 to C64 are coins of the smallest diameter among coins handled by the money handling apparatus 1, for example. A coin C65 indicated by a dotted line is a coin of the greatest diameter among the coins handled by the money handling apparatus 1, for example. The coin C65 cannot be caught on the protrusions 52 while the coins C61 to C64 are caught on the protrusions 52. That is, the coin C65 can alone be caught on the protrusions 52.

The protrusions 52 are of such a shape that, of the coins C61 and C63 lying side-by-side in the radial direction, the coin C63 located on the center side of the disk 51 is caused to fall into a space formed by the cover 53 (which may be simply referred to as "space" hereinafter). The protrusions 52 also are of such a shape that, of the coins C62 and C64 lying side-by-side in the radial direction, the coin C64 located on the center side of the disk 51 is caused to fall into the space. For example, the height of each of the protrusions 52 from the peripheral edge 51*a* as indicated by an arrow A41 in FIG. 19 is shorter than the distance from the peripheral edge 51*a* to the center of the coin C63 as indicated by an arrow A42 in FIG. 19. Thus, the coin C63, when carried upward by the disk 51, comes off the protrusions 52 and falls into the space. Likewise, the coin C64 also comes off the protrusions 52 and falls into the space when carried upward by the disk 51.

The protrusions 52 also have such a shape as to prevent the coin C65 from falling off the protrusions 52 into the space when the coin C65 is caught on the protrusions 52. For example, the height of each of the protrusions 52 from the peripheral edge 51*a* as indicated by the arrow A41 in FIG. 19 is greater than the distance from the peripheral edge 51*a* to the center of the coin C65 as indicated by an arrow A43 in FIG. 19. Thus, the coin C65 continues to be carried upward without coming off the protrusions 52.

As described above, of the coins C61 to C64 caught on the protrusions 52 of the disk 51, the coins C63 and C64 located on the center side of the disk 51 come off the protrusions 52 and fall into the space. Therefore, two coins C61 and C62 lying side-by-side in the circumferential direction of the disk 51 are left on the protrusions 52. The separation cam 54 causes the coin C62 to fall into the space. The coin C62 is, in the rotational direction of the disk 51, the leading one of the coins C61 and C62 lying side-by-side in the circumferential direction of the disk 51 (such a leading coin may also be simply referred to as the "leading coin").

Figure 20:
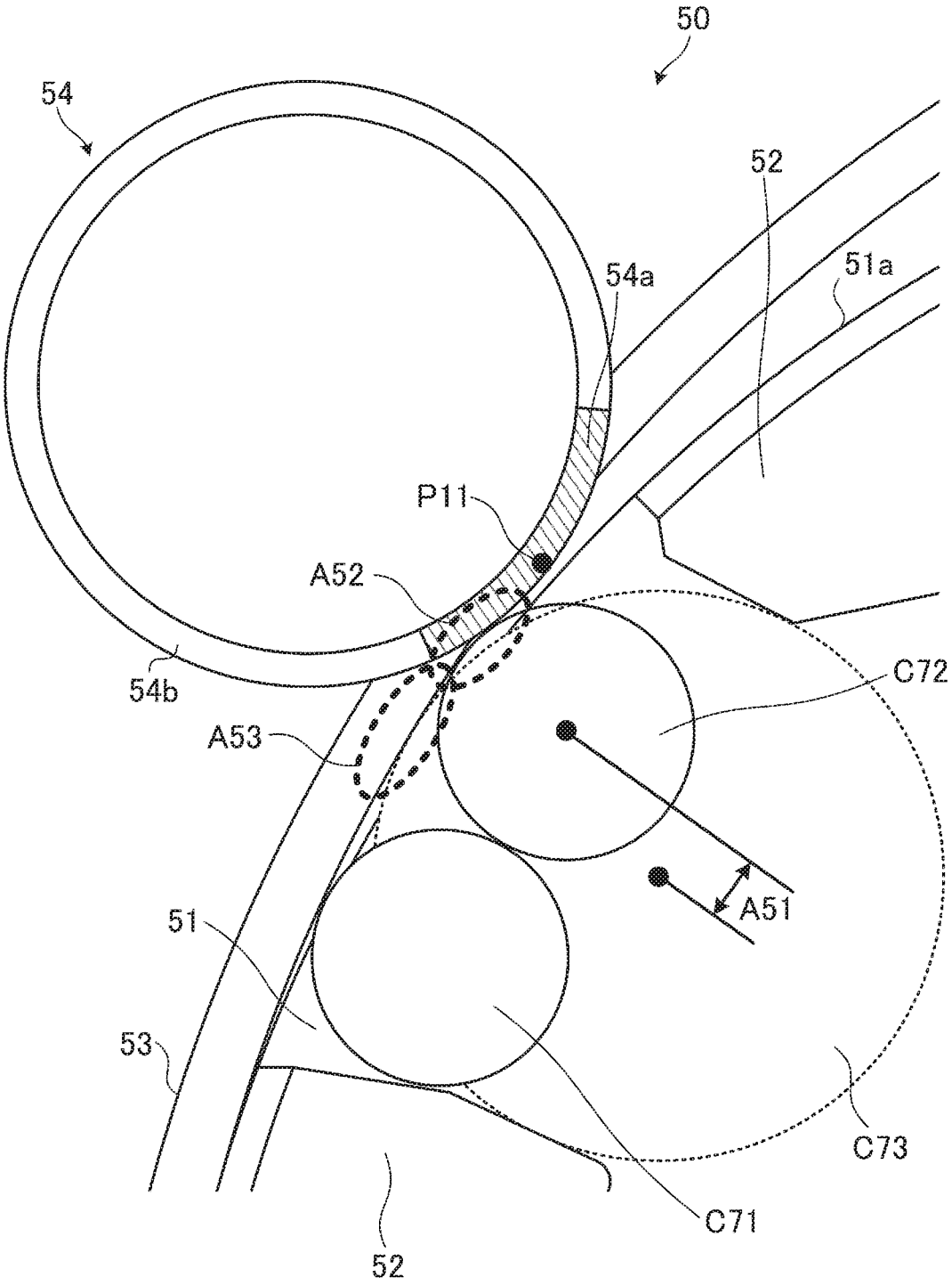
FIG. 20 is an explanatory view for explaining an operation of causing a leading coin out of two coins lying side-by-side in the circumferential direction to fall.

FIG. 20 is an explanatory view for explaining an operation of causing a leading coin out of two coins lying side-by-side in the circumferential direction to fall. The same components between FIGS. 19 and 20 are provided with the same reference symbols. A coin C73 indicated by a dotted line in FIG. 20 is a coin of the greatest diameter among the coins handled by the money handling apparatus 1, for example.

As described above, the cover 53 includes the side wall disposed to diverge from the peripheral edge 51*a* of the disk 51 with decreasing distance to the separation cam 54. Further, as indicated by a double-headed arrow A51 in FIG. 20, the center of the coin C72 and the center of the coin C73 are different from each other in position in the circumferential direction of the disk 51. In other words, the straight line in the radial direction passing through the center of the coin C72 and the straight line in the radial direction passing through the center of the coin C73 do not overlap. Thus, a portion of the coin C72 projecting out from the peripheral edge 51*a* of the disk 51 and a portion of the coin C73 projecting out from the peripheral edge 51*a* of the disk 51 project out from the disk 51 at different positions. For example, the portion of the coin C72 projecting out from the peripheral edge 51*a* of the disk 51 as indicated in the dotted frame A52 is located at a leading position with respect to the portion of the coin C73 projecting out from the peripheral edge 51*a* of the disk 51 as indicated in the dotted frame A53. Therefore, the portion of the coin C72 projecting out from the peripheral edge 51*a* of the disk 51 first reaches the position P11 in FIG. 20, and the portion of the coin C73 projecting out from the peripheral edge 51*a* of the disk 51 then reaches the position P11 in FIG. 20. Note that, the position P11 in FIG. 20 is a position which the portions of the coins C72 and C73 projecting out from the peripheral edge 51*a* of the disk 51 pass, and is also a position which the lower portion 54*a* and the higher portion 54*b* of the rotating separation cam 54 pass.

The surface of the lower portion 54*a* of the separation cam 54 is flush with or lower than the surface of the disk 51. The surface of the higher portion 54*b* of the separation cam 54 is higher than the surface of the disk 51. When the leading coin C72 passes the position P11, the lower portion 54*a* of the separation cam 54 is switched to the higher portion 54*b* at the position P11. Thus, the coin C72 is scooped up by the separation cam 54 and caused to fall into the space.

When the coin C73 passes the position P11, the higher portion 54*b* of the separation cam 54 is located at the position P11. The coin C73 makes contact with the side surface of the separation cam 54 having a substantially cylindrical shape, and is not scooped up by the separation cam 54. The coin C73 is carried upward steadily. The coin C71 behind the coin C72 also makes contact with the side surface of the separation cam 54 having the substantially cylindrical shape, is not scooped up by the separation cam 54, and is carried upward steadily. As described above, of the two coins C71 and C72 carried upward while lying side-by-side in the circumferential direction, the coin feeding apparatus 50 causes the leading coin C72 to fall into the space.

Figure 21:
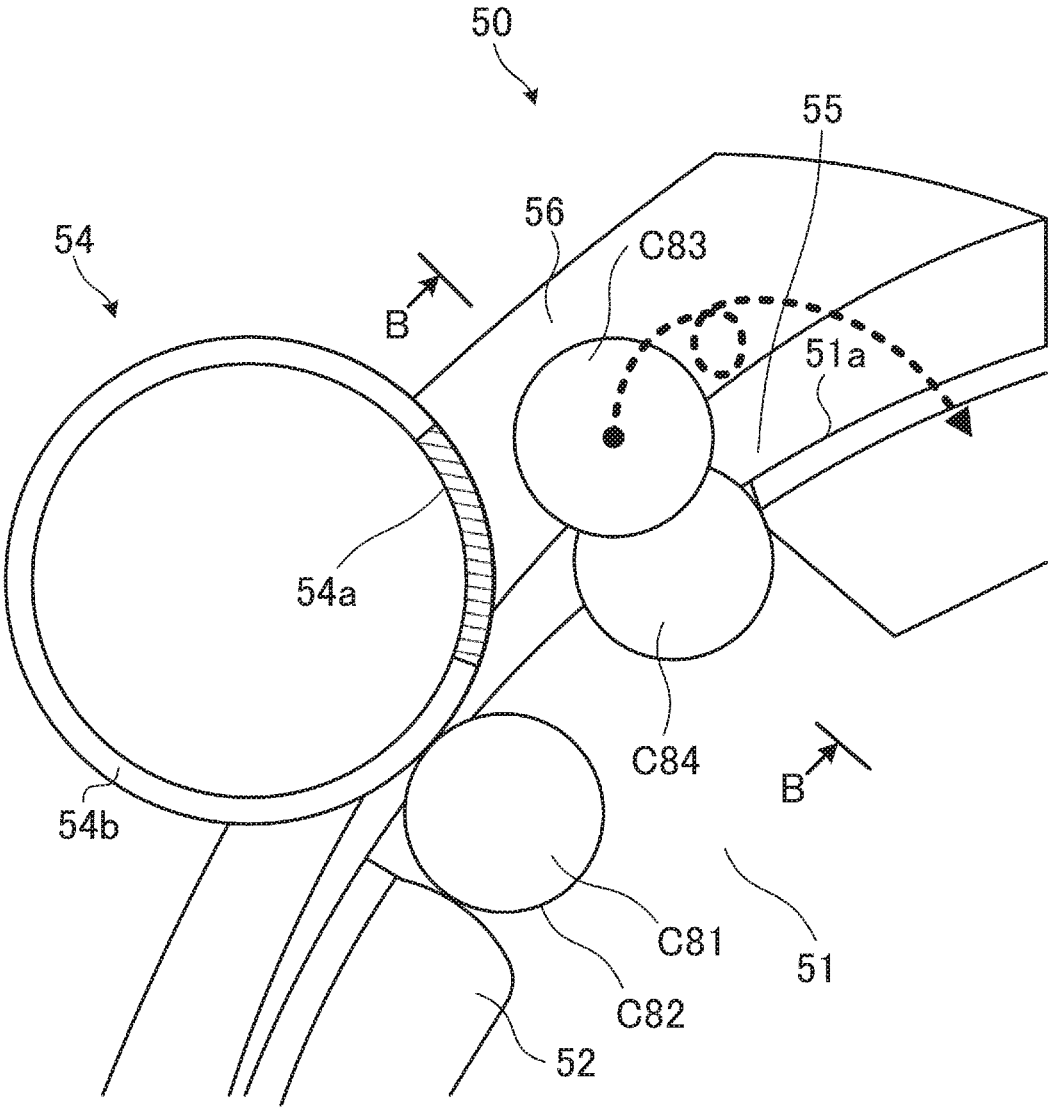
FIG. 21 is an explanatory view for explaining a structure for causing an upper coin out of two overlapping coins to fall.

FIG. 21 is an explanatory view for explaining a structure for causing an upper coin out of two overlapping coins to fall. The same components between FIGS. 20 and 21 are provided with the same reference symbols. Illustration of FIG. 21 is made with partial modification in shape or the like in comparison with illustration of FIG. 20.

As illustrated in FIG. 21, the coin feeding apparatus 50 comprises a flat plate 55 disposed in the periphery of the peripheral edge 51*a* of the disk 51, and a flat plate 56 disposed in the periphery of the plate 55. The surface of the plate 55 is flush with or lower than the surface of the disk 51. The surface of the plate 56 is higher than the surface of the plate 55. Note that, illustration of the plate 56 is omitted in FIG. 20.

Coins C81 and C82 are caught on the protrusions 52 of the disk 51 while overlapping each other. The coin C82 is under the coin C81.

A coin C83 represents the coin C81 carried upward by the disk 51. A coin C84 represents the coin C82 carried upward by the disk 51. In FIG. 21, illustration of a state of rotation of the disk 51 is omitted. The centrifugal force moves the coin C83 toward the outside of the disk 51. The coin C84 is carried upward on the plate 55 by virtue of a step between the plate 55 and the plate 56, which will be described below.

Figure 22:
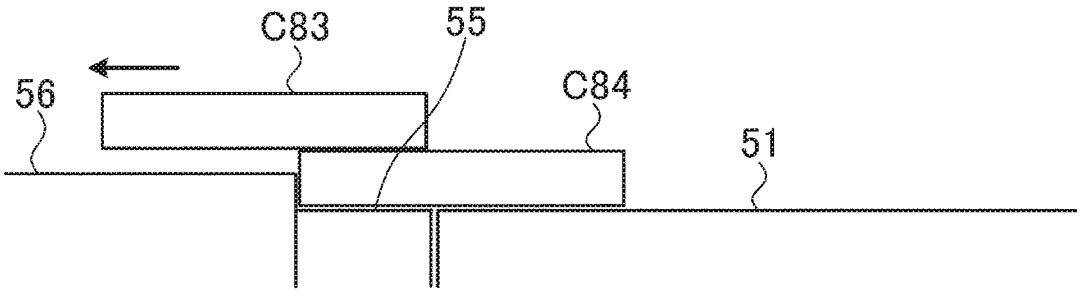
FIG. 22 is a sectional view taken along a line B-B and seen in a direction of arrows B in FIG. 21.

FIG. 22 is a sectional view taken along a line B-B and seen in a direction of arrows B in FIG. 21. The same components between FIGS. 21 and 22 are provided with the same reference symbols. As illustrated in FIG. 22, the surface of the plate 56 is higher than the surface of the plate 55. The step between the plate 55 and the plate 56 has a smaller thickness than the thickness of each of the coins C83 and C84. Thus, the lower coin C84 (coin C82) of the two overlapping coins C83 and C84 (coins C81 and C82) is caught on the step between the plate 55 and the plate 56. Then, the lower coin C84 (coin C82) is carried upward while being caught on the protrusions 52 of the disk 51. In contrast, the centrifugal force moves the upper coin C83 (coin C81) to the outside of the disk 51. The upper coin C83 (coin C81) which has moved to the outside of the disk 51 comes off the protrusions 52 of the disk 51. After having come off the protrusions 52 of the disk 51, the upper coin C83 (coin C81) falls into the space.

In FIG. 22, the step between the plate 55 and the plate 56 has a smaller thickness than the thickness of each of the coins C83 and C84, but may also have the same thickness as each of the coins C83 and C84. The step between the plate 55 and the plate 56 only has to have a thickness the same as or smaller than that of the coin having the smallest thickness among the coins handled by the coin payout apparatus 50, for example.

As described above, the coin feeding apparatus 50 comprises: the disk 51 that includes the protrusions 52 on the surface of the disk 51, is disposed to be inclined and rotatable, and, when rotating, causes a first coin or a second coin to be caught on and carried by the protrusions 52, the second coin having a diameter greater than that of the first coin; the cover 53 that forms, between the cover 53 and the surface of the disk 51, the space for storing a coin therein; and the separation cam 54 that separates a leading coin out of two of the first coins from the protrusions 52 so as to cause the leading coin to fall into the space, the two first coins being caught on the protrusions 52 while lying side-by-side in the circumferential direction of the disk 51. Thus, the coin feeding apparatus 50 is capable of feeding to a transport path the stored coins ranging from a coin of small diameter to a coin of large diameter one by one.

(Modification 1)

The method of separating from the disk an outer coin out of two coins caught on while lying side-by-side in the radial direction is not limited to the separation cam 36 in the description of Embodiment 1. In addition, the method of separating from the disk a leading coin out of two coins caught on while lying side-by-side in the circumferential direction is not limited to the separation cam 54 in the description of Embodiment 2. For example, the coin feeding apparatus 21 may also comprise a protrusion for separating the coin C22 from the disk 31 when the outer coin C22 is located at the position P1 illustrated in FIG. 9.

Figure 23:
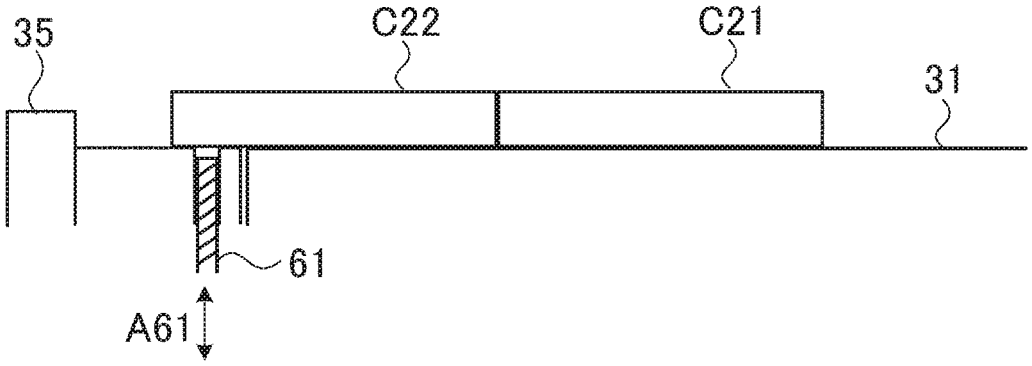
FIG. 23 is a sectional view taken along a line C-C and seen in a direction of arrows C in FIG. 9.

FIG. 23 is a sectional view taken along a line C-C and seen in a direction of arrows C in FIG. 9. The same components between FIGS. 9 and 23 are provided with the same reference symbols. In FIG. 23, the coin feeding apparatus 21 comprises a protrusion 61 instead of the separation cam 36. The protrusion 61 is disposed, for example, at the position P1 illustrated in FIG. 9.

The protrusion 61 is cylindrical. The upper end surface of the protrusion 61 is usually located below the surface of the disk 31. The upper end surface of the protrusion 61 protrudes upward above the surface of the disk 31 when the outer coin C22 of the two coins C21 and C22 lying side-by-side in the radial direction of the disk 31 passes the position P1. Accordingly, the coin C22 is separated from the disk 31. The protrusion 61 may, for example, be moved in the direction of double-headed arrow A61 in FIG. 23 using a solenoid or the like. The coin feeding apparatus 50 in the description of Embodiment 2 may also have a protrusion at the position P11 illustrated in FIG. 20, for example.

(Modification 2)

The separation cam 36 in the description of Embodiment 1 rotates counterclockwise, but may also rotate clockwise. This also allows the coin feeding apparatus 21 to cause the outer one of the two coins caught on while lying side-by-side in the radial direction to fall into the space A1. In addition, the separation cam 54 in the description of Embodiment 2 rotates counterclockwise, but may also rotate clockwise. This also allows the coin feeding apparatus 50 to cause the leading one of the two coins caught on while lying side-by-side in the circumferential direction to fall into the space.

(Modification 3)

The present embodiments have been described in relation to an aspect in which the separation cam 36 is used to prevent two or more coins from being fed, but another separation member may also be disposed in the storing/feeding unit. For example, a separation lever may further be disposed downstream of the separation cam 36 in the transport direction of coins transported by the inclined disk. The separation lever operates in synchronization with the inclined disk and/or the separation cam 36. Specifically, the separation lever is disposed to turn about an axis, and, a spring brings the separation lever into contact with a coin whose transport state is disturbed by the separation cam 36 in the direction opposite to the rotational direction of the inclined disk, so as to cause the coin to fall into the storing space formed by the inclined disk and the cover.

Further, the other separation member is not limited to the separation lever as described above. A second separation cam similar to the separation cam 36 may also be disposed, or the separation lever combined with the second separation cam may also be disposed. The second separation cam may be disposed downstream of the separation lever in the transport direction of the coin transported by the inclined disk.

REFERENCE SIGNS LIST

1 Money handling apparatus
11 Inlet
12 Outlet
21 Coin feeding apparatus
22 Pulley
23 Belt
24*a* to 24*c* Transport path
25 Storing/feeding unit
25*a* Disk
25*b* Cover
25*c* Guide
26 Transport path
27 Collecting box
31 Disk
31*a* Peripheral edge
32 Guide
32*a* Upper surface
33 Separation disk
34 Pulley
35 Cover
36 Separation cam
36*a* Lower portion
36*b* Higher portion
37 Pushing-aside lever
38 First protrusion
39 Second protrusion
40 Recess
41 Notch
50 Coin feeding apparatus
51 Disk
51*a* Peripheral edge
52 Protrusion
53 Cover
54 Separation cam
54*a* Lower portion
54*b* Higher portion
55, 56 Plate
61 Protrusion

The invention claimed is:

1. A coin feeding apparatus, comprising:

a disk that includes a plurality of protrusions on a surface of the disk, is disposed to be inclined and rotatable, and, when rotating, causes one or more coins from a mixture of a first coin and a second coin to be caught on and carried upward by the plurality of protrusions, the second coin having a diameter greater than that of the first coin;

a cover that forms, between the cover and the surface of the disk, a space for storing a coin therein; and a separation unit that when the plurality of protrusions catches two first coins lying side by side in a radial direction of the disk, separates one coin of the two first coins located outer in the radial direction of the disk from the plurality of protrusions so as to cause the one coin to fall into the space, wherein the plurality of protrusions are disposed on the surface of the disk such that when the plurality of protrusions catches two first coins lying side by side in the radial direction of the disk, a portion of the first coin located outer in the radial direction of the disk projects from a peripheral edge of the disk, and wherein when the plurality of protrusions catches two first coins lying side by side in the radial direction of the disk, the separation unit makes contact with a portion of the first coin located outer in the radial direction of the disk to cause the first coin located outer in the radial direction of the disk to come off the disk and to fall into the space, and when the plurality of protrusions catches one second coin, the separation unit does not make contact with the second coin.

2. The coin feeding apparatus according to claim 1, wherein the portion of the first coin located outer in the radial direction of the disk and a portion of the second coin project out from the disk at different positions.

3. The coin feeding apparatus according to claim 1, wherein the separation unit includes a contact unit that moves between a first position and a second position in synchronization with rotation of the disk.

4. The coin feeding apparatus according to claim 3, wherein, when the portion of the first coin located outer in the radial direction of the disk passes the first position, the contact unit moves to the first position and makes contact with the first coin located outer in the radial direction of the disk.

5. The coin feeding apparatus according to claim 3, wherein, when the portion of the second coin passes the first position, the contact unit moves to the second position and does not make contact with the second coin.

6. The coin feeding apparatus according to claim 1, wherein the separation unit is a cam including a cylindrical end surface provided with a higher portion and a lower portion, the cylindrical end surface being configured to rotate in synchronization with rotation of the disk, the higher portion of the cylindrical end surface making contact with the portion of the first coin located outer in the radial direction of the disk.

7. The coin feeding apparatus according to claim 1, wherein some of the plurality of protrusions are disposed on a central portion of the disk, and each include a surface that faces in the radial direction of the disk and makes contact with a peripheral edge of a coin, and the coin feeding apparatus further comprises:

a pushing-aside member that when the plurality of protrusions catches the second coin, makes contact with the second coin at a position outside of the disk, so as to push aside the second coin in a center direction of the disk and cause a side surface of the second coin to make contact with the surface of one of the protrusions disposed on the central portion of the disk.

8. The coin feeding apparatus according to claim 1, wherein the cover includes a first side wall disposed along a peripheral edge of the disk and a second side wall disposed to diverge from the peripheral edge of the disk with decreasing distance to the separation unit.

9. The coin feeding apparatus according to claim 1, wherein when the plurality of protrusions catches two first coins lying side by side in a circumferential direction of the disk, the separation unit separates a leading coin of the two first coins lying side by side in a circumferential direction of the disk from the plurality of protrusions so as to cause the leading coin to fall into the space.

10. A money handling apparatus, comprising:

the coin feeding apparatus according to claim 1.

* * * * *